US011311455B2

(12) United States Patent
Lin

(10) Patent No.: US 11,311,455 B2
(45) Date of Patent: Apr. 26, 2022

(54) MULTI-DIRECTION OPERABLE MASSAGE CHAIR

(71) Applicant: Chao-Feng Lin, New Taipei (TW)

(72) Inventor: Chao-Feng Lin, New Taipei (TW)

( * ) Notice: Subject to any disclaimer, the term of this patent is extended or adjusted under 35 U.S.C. 154(b) by 127 days.

(21) Appl. No.: 15/931,597

(22) Filed: May 14, 2020

(65) Prior Publication Data

US 2020/0397652 A1 Dec. 24, 2020

(30) Foreign Application Priority Data

Jun. 20, 2019 (TW) ..... 108121602

(51) Int. Cl.
*A61H 23/02* (2006.01)
*A61H 15/00* (2006.01)

(52) U.S. Cl.
CPC ..... *A61H 23/02* (2013.01); *A61H 15/0078* (2013.01); *A61H 2015/0014* (2013.01); *A61H 2201/0103* (2013.01); *A61H 2201/0149* (2013.01); *A61H 2201/0176* (2013.01); *A61H 2201/1609* (2013.01); *A61H 2201/1635* (2013.01); *A61H 2201/1642* (2013.01); *A61H 2201/5082* (2013.01); *A61H 2203/0425* (2013.01); *A61H 2230/505* (2013.01)

(58) Field of Classification Search
CPC .... A61H 23/02; A61H 15/0078; A61H 23/00; A61H 15/00; A61H 2015/0007; A61H 2015/0014; A61H 2201/0149; A61H 2203/0425; A61H 2201/5082
See application file for complete search history.

(56) References Cited

U.S. PATENT DOCUMENTS

2019/0046385 A1* 2/2019 Le ..... A61H 1/00
2019/0307634 A1* 10/2019 Moritomo ..... A61H 23/006
2020/0260883 A1* 8/2020 Jacobs ..... A47C 7/624

FOREIGN PATENT DOCUMENTS

WO WO-2020091377 A1 * 5/2020 ..... A61H 7/007

* cited by examiner

*Primary Examiner* — Samchuan C Yao
*Assistant Examiner* — Tyler A Raubenstraw

(57) ABSTRACT

A multi-direction operable massage chair includes a seat positioning device; a seat sensor of a limit member; a neck massaging device; a shoulder massaging device, and an arm massaging device together configured to move along a main rail in the y-axis direction; a back massaging device; a leg positioning device; a vibrational massaging seat including an adjustment member and two adjustment cylinders; a plurality of roller members configured to roll in different directions; first, second, third, and fourth infrared temperature sensors configured to sense temperatures of the arms, the neck, the back, and the legs of the user respectively; a board adjustment member of the leg massaging device configured to extend or retract; a board of the leg massaging device configured to rotate; and a pivotal armrest link.

1 Claim, 29 Drawing Sheets

MULTI-DIRECTION OPERABLE MASSAGE CHAIR

BACKGROUND OF THE INVENTION

1. Field of the Invention

The invention relates to massage chairs and more particularly to a massage chair having massaging devices capable of moving along the x-axis or the y-axis in operation.

2. Description of Related Art

Massage chairs are well known in the art. However, conventional massage chairs are capable of massaging a user in a plane fashion only, have only one kind of massaging devices for rubbing, kneading or punching, and cannot accommodate users of different body sizes. Furthermore, a user is liable to be hurt by the massage char in operation if sufficient care is not taken.

Thus, the need for improvement still exists.

SUMMARY OF THE INVENTION

It is therefore one object of the invention to provide a multi-direction operable massage chair comprising a seat positioning device configured to move along the x-axis; a seat sensor of a limit member configured to sense a movement of the seat positioning device wherein the limit member is configured to deactivate the seat positioning device after the seat positioning device has moved to a predetermined position; a neck massaging device, a shoulder massaging device, and an arm massaging device together configured to move along a main rail in the y-axis direction until first rollers sense a user wherein the neck massaging device is configured to move along its axis until second rollers contact the user, and the arm massaging device is configured to move along its axis until third rollers contact the arm of the user; a width adjustment axis of the arm massaging device configured to move toward the arm until the third rollers contact the arm of the user; a back massaging device configured to move along the main rail in the y-axis direction until a height limit sensor senses the shoulder massaging device; a leg positioning device of a leg massaging device is inflated until two leg sensors contact and sense the user; a vibrational massaging seat including an adjustment member and two adjustment cylinders and configured to adjust an angle of the vibrational massaging seat with respect to the user; a plurality of roller members configured to roll in different directions; first, second, third, and fourth infrared temperature sensors configured to sense temperatures of the arms, the neck, the back, and the legs of the user respectively; a board adjustment member of the leg massaging device configured to extend or retract; a board of the leg massaging device configured to rotate; an armrest link configured to pivot; and an armrest pivot configured to pivot.

The above and other objects, features and advantages of the invention will become apparent from the following detailed description taken with the accompanying drawings.

DETAILED DESCRIPTION OF THE INVENTION

Figure 1:
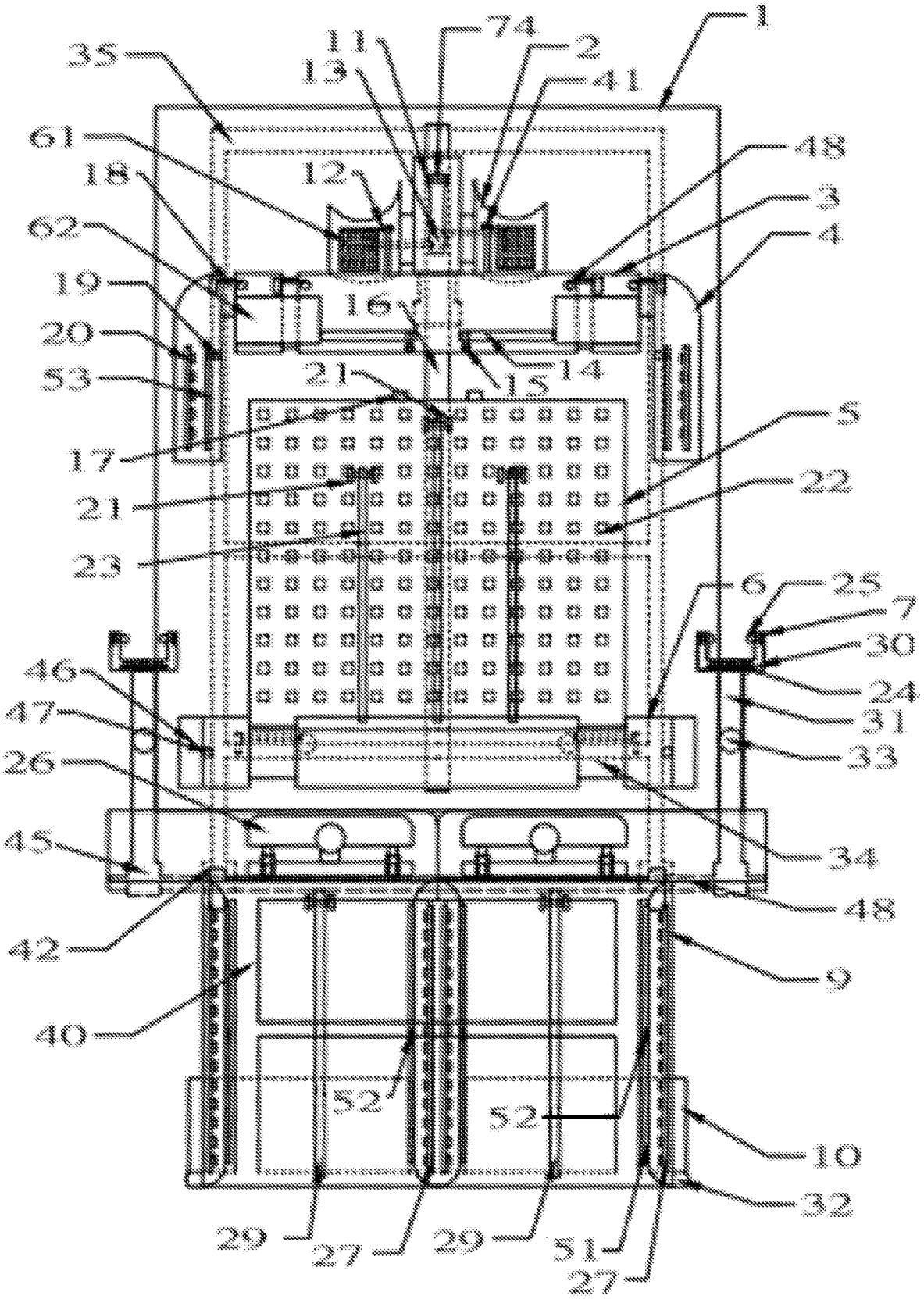
FIG. 1 is a front view of a multi-direction operable massage chair according to the invention.
Figure 2:
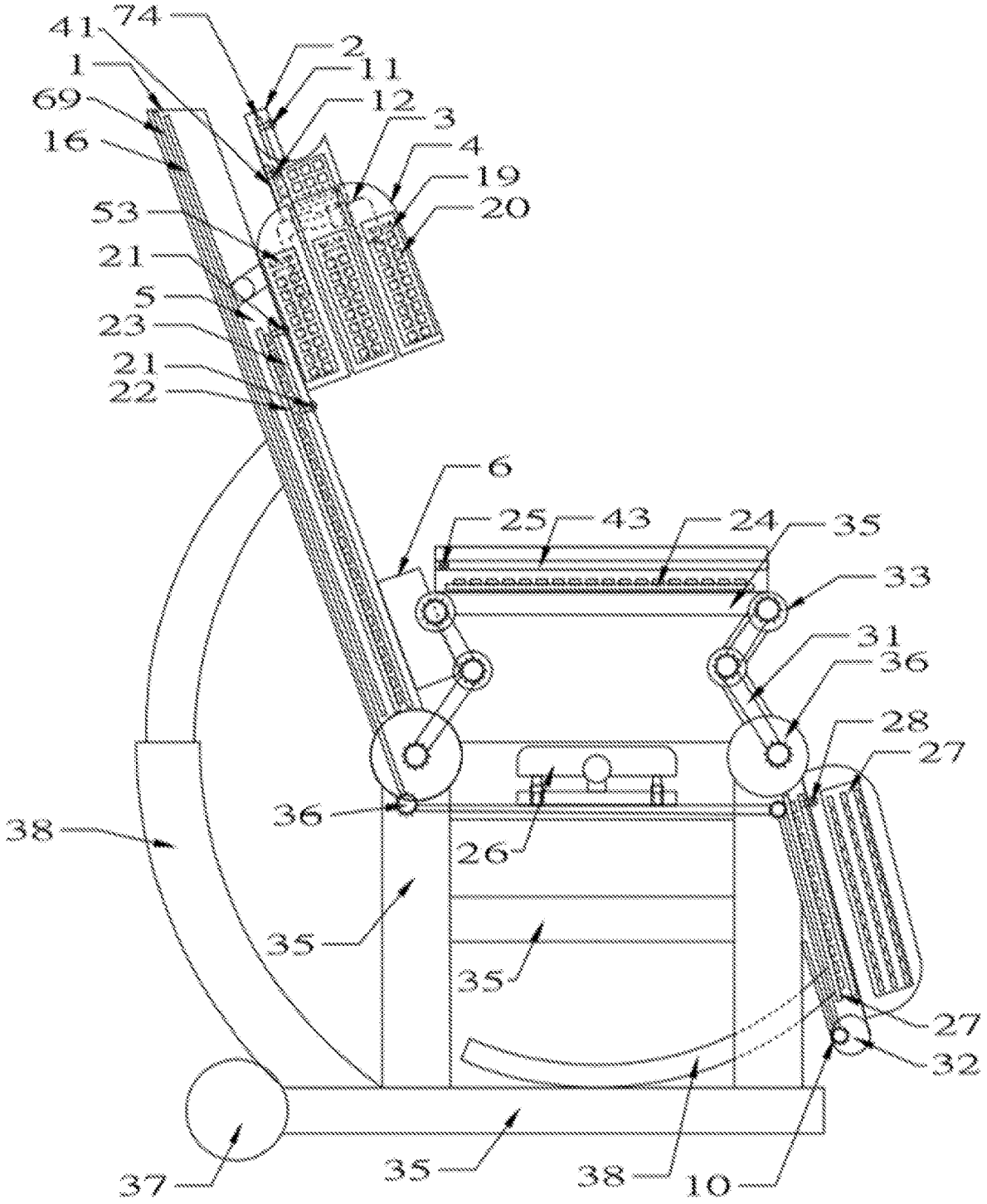
FIG. 2 is a side elevation of FIG. 1.
Figure 3:
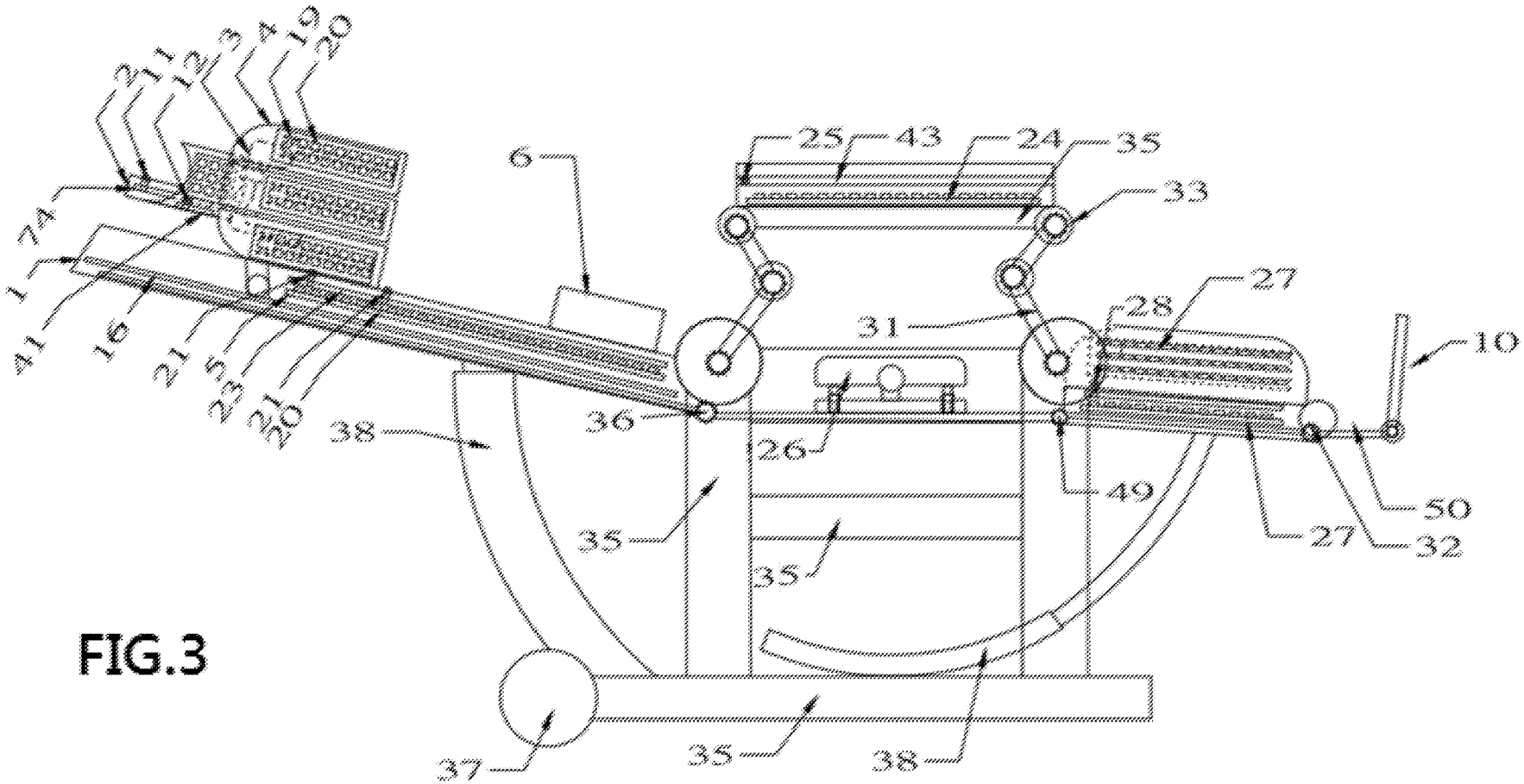
FIG. 3 is a side elevation of FIG. 1 with the back being leaned and the foot rest being pivoted a horizontal position.
Figure 4:
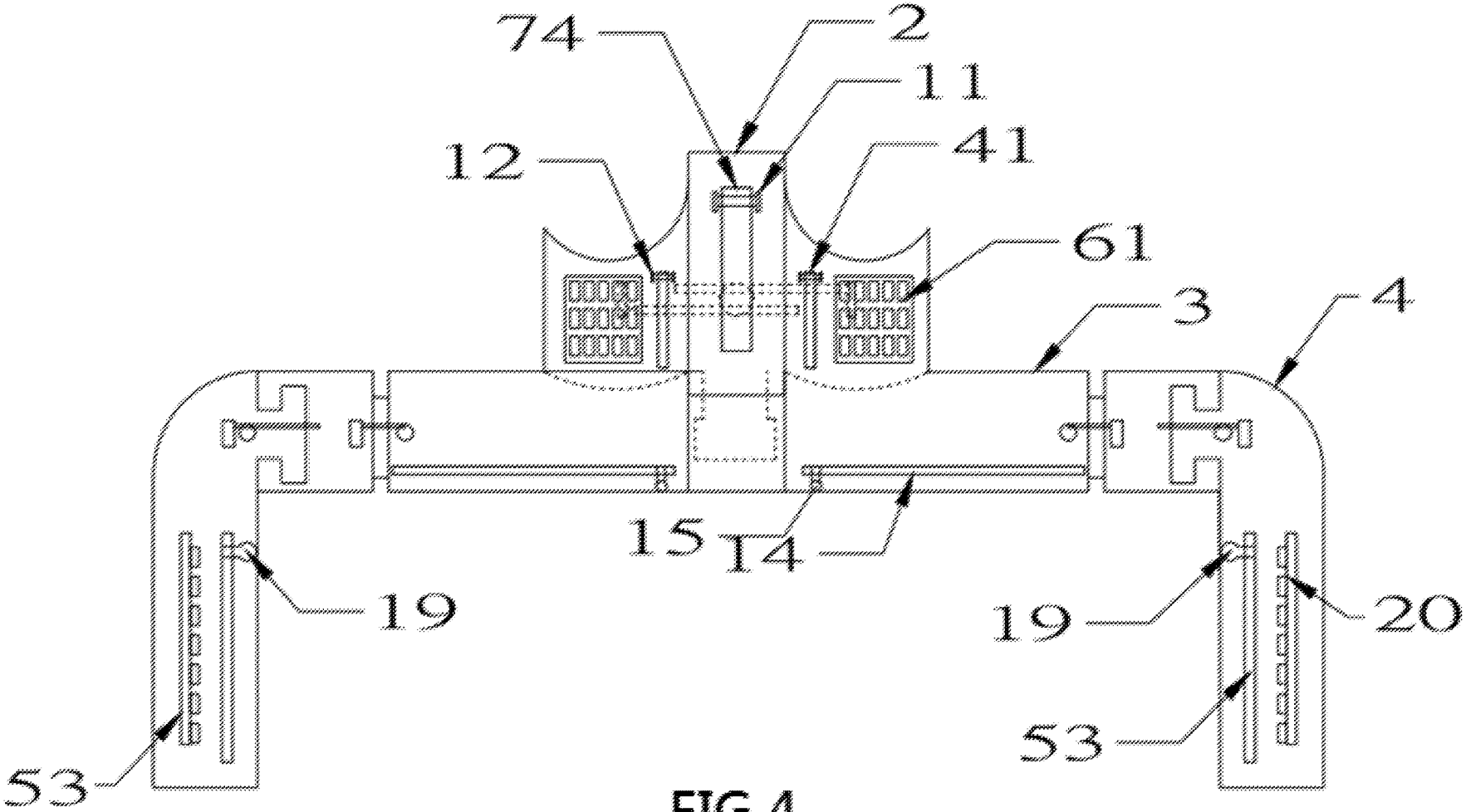
FIG. 4 is a front view showing the shoulder massaging device, the neck massaging device, and the arm massaging devices of a first embodiment.
Figure 5:
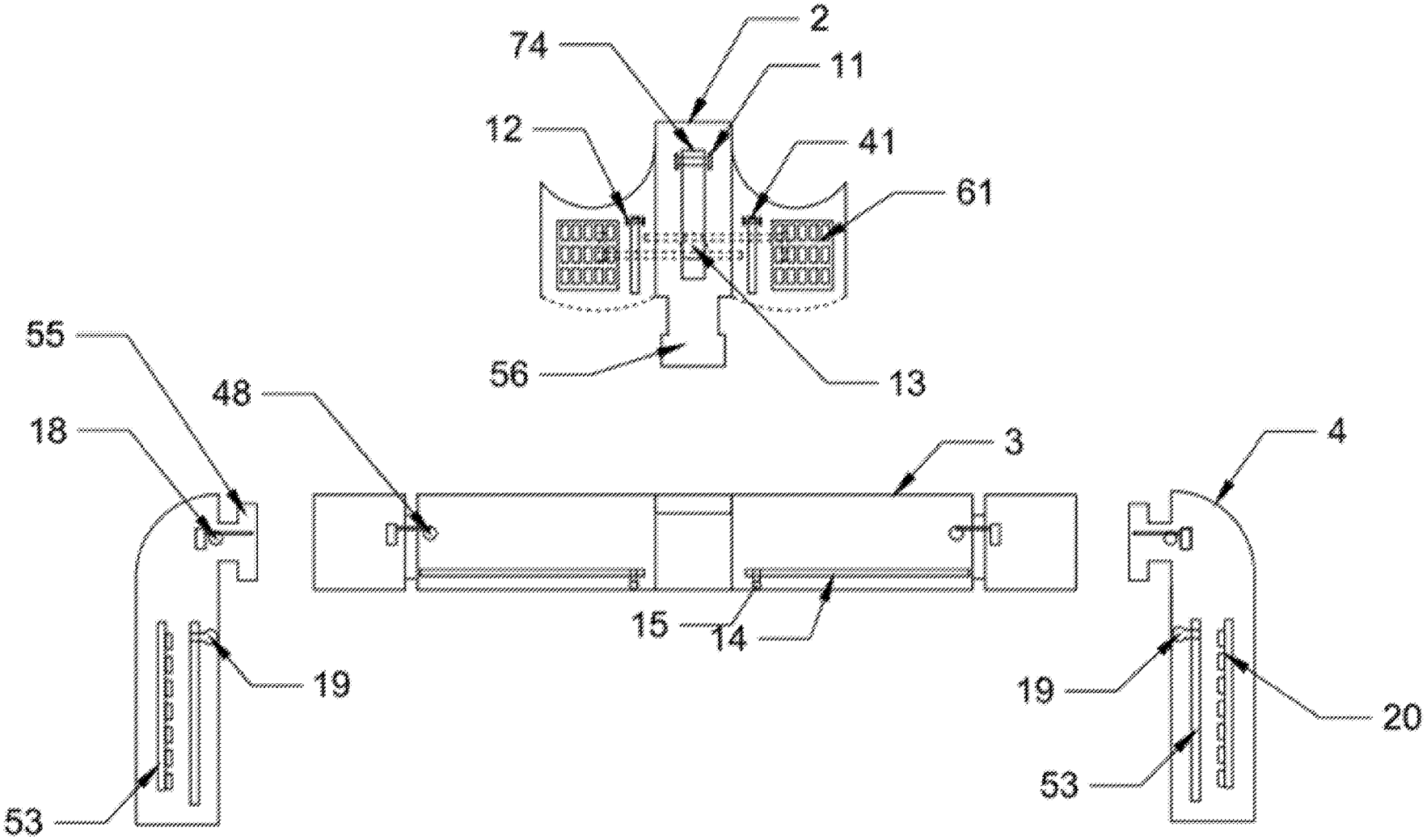
FIG. 5 is an exploded view of FIG. 4.
Figure 6:
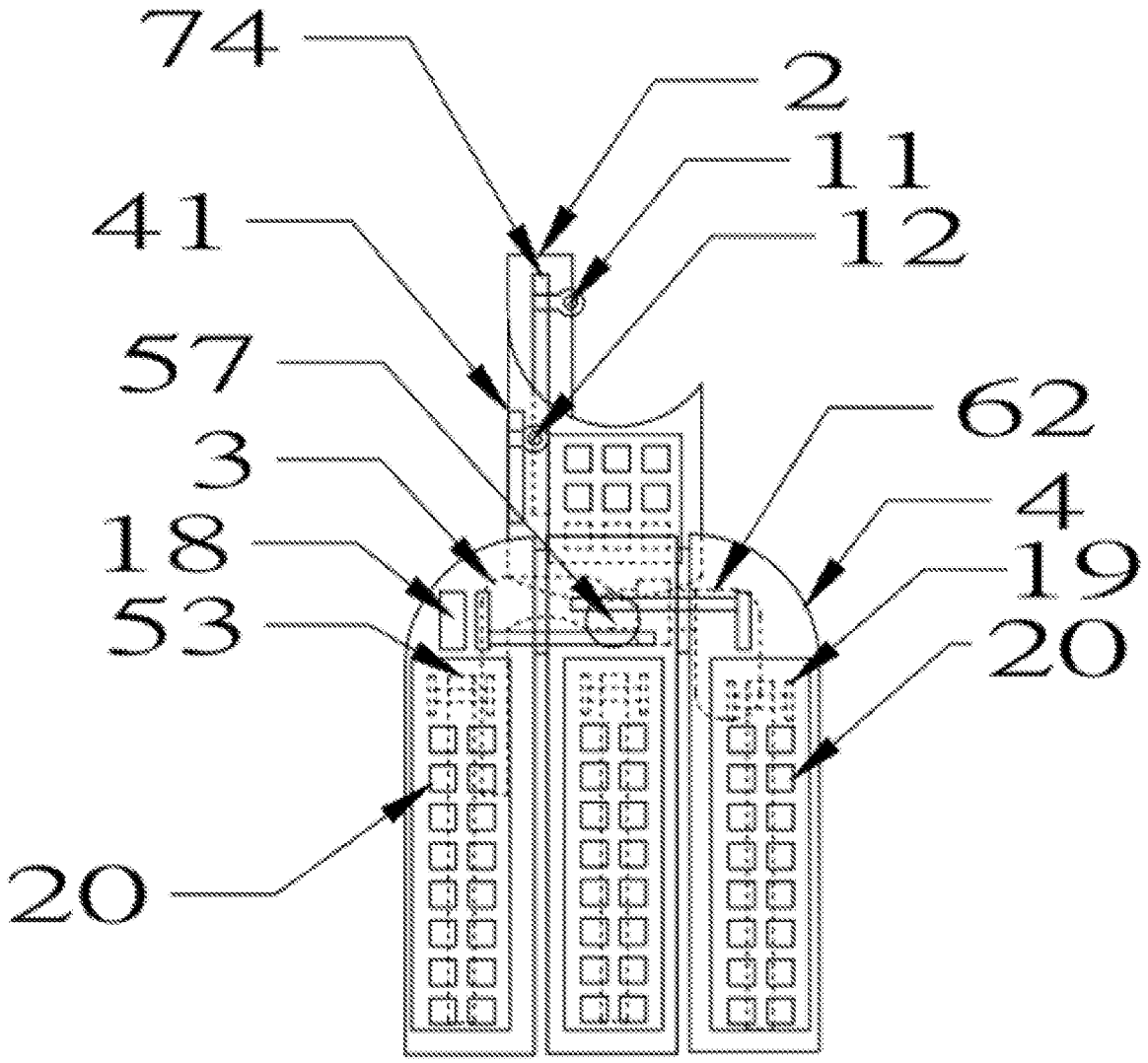
FIG. 6 is a side elevation of FIG. 4.
Figure 7:
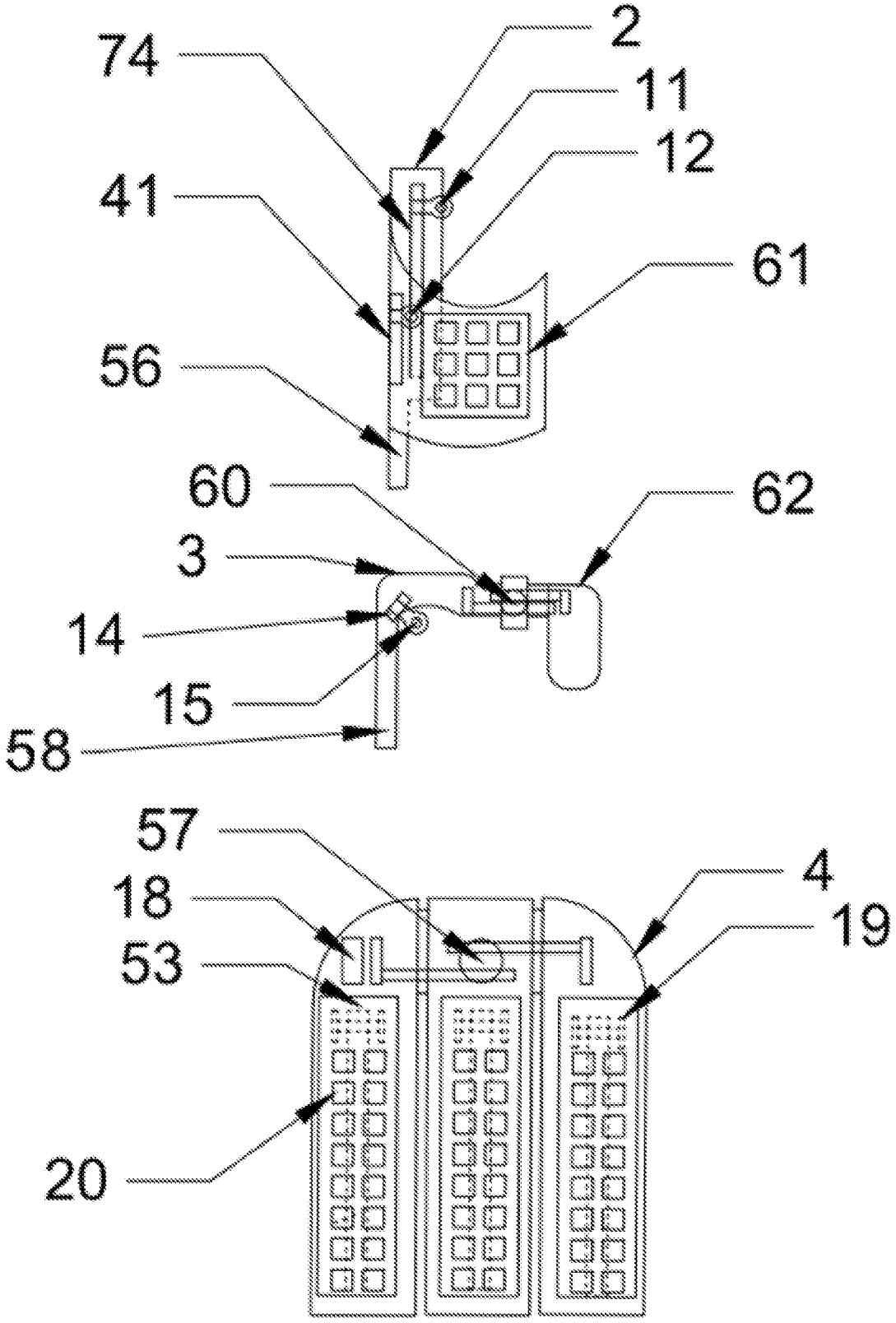
FIG. 7 is an exploded view of FIG. 6.
Figure 8:
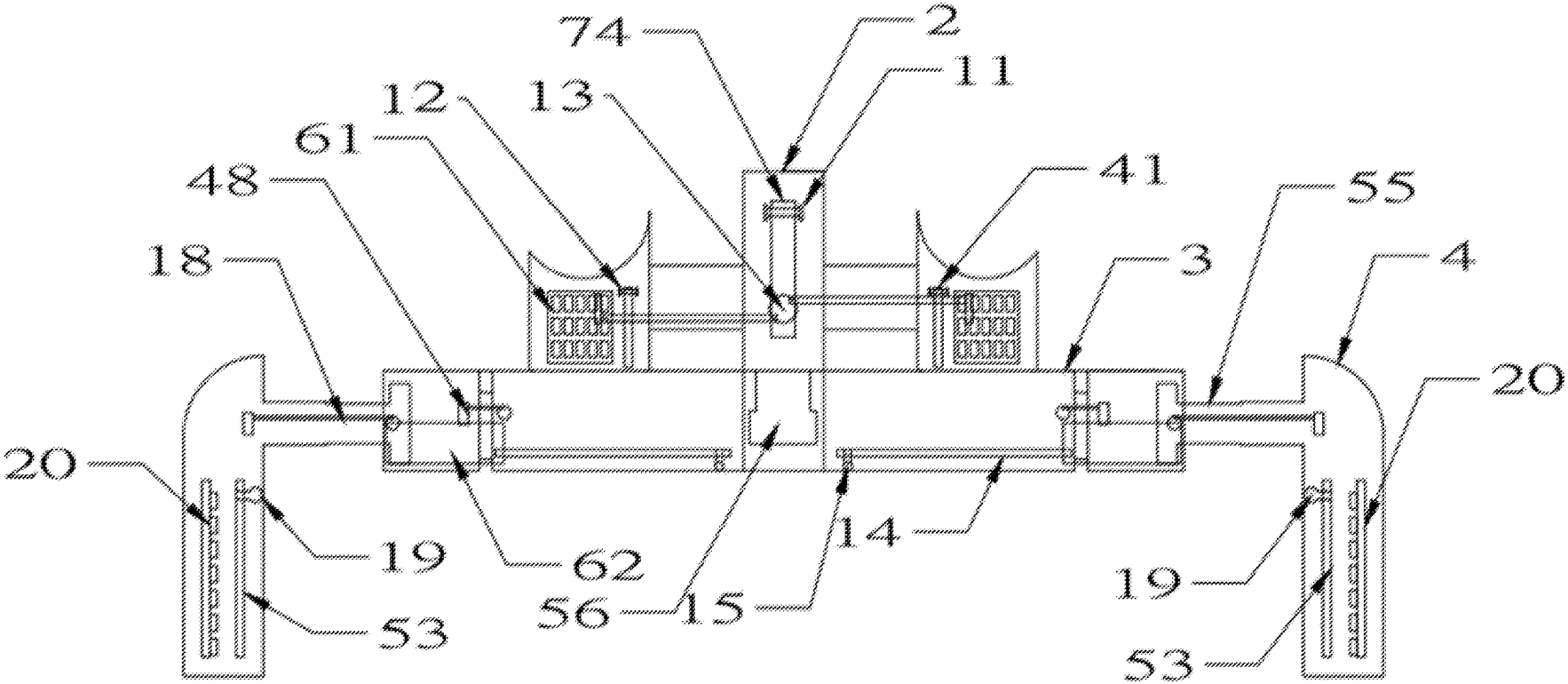
FIG. 8 is a view similar to FIG. 4 showing the shoulder massaging device, the neck massaging device, and the arm massaging devices being not in position.
Figure 9:
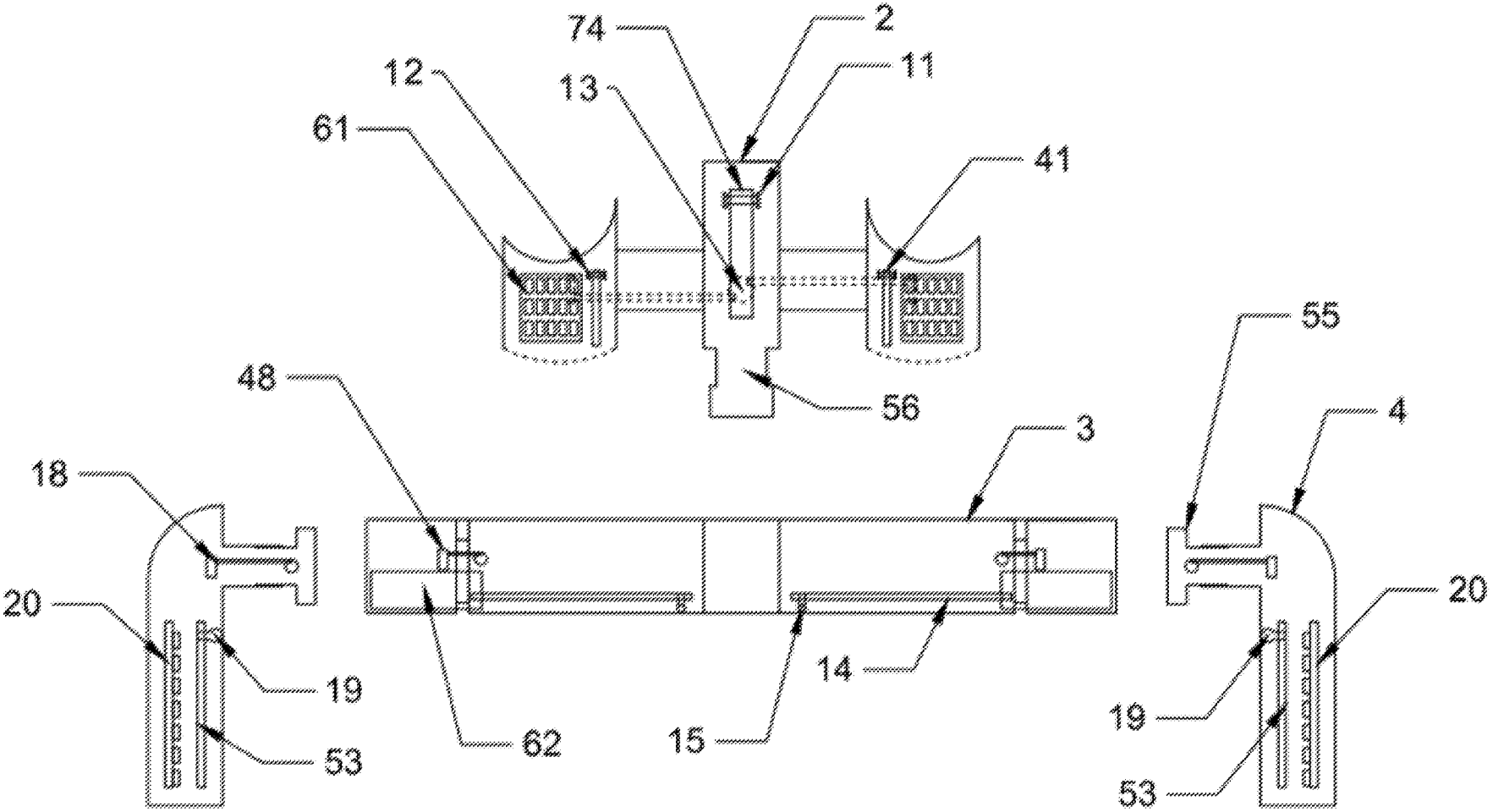
FIG. 9 is an exploded view of FIG. 8.
Figure 10:
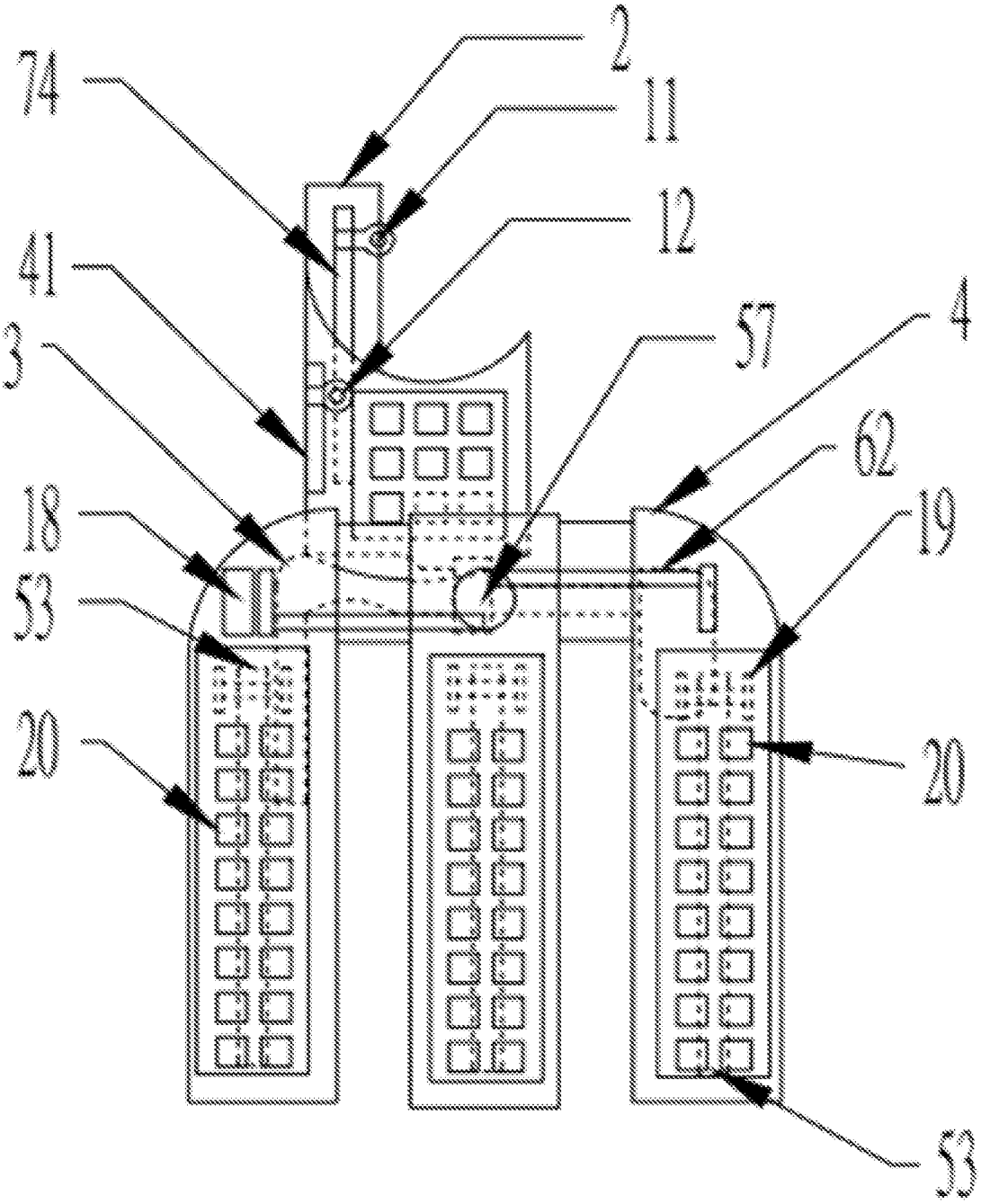
FIG. 10 is a view similar to FIG. 6 showing the shoulder massaging device, the neck massaging device, and the arm massaging devices being not in position.
Figure 11:
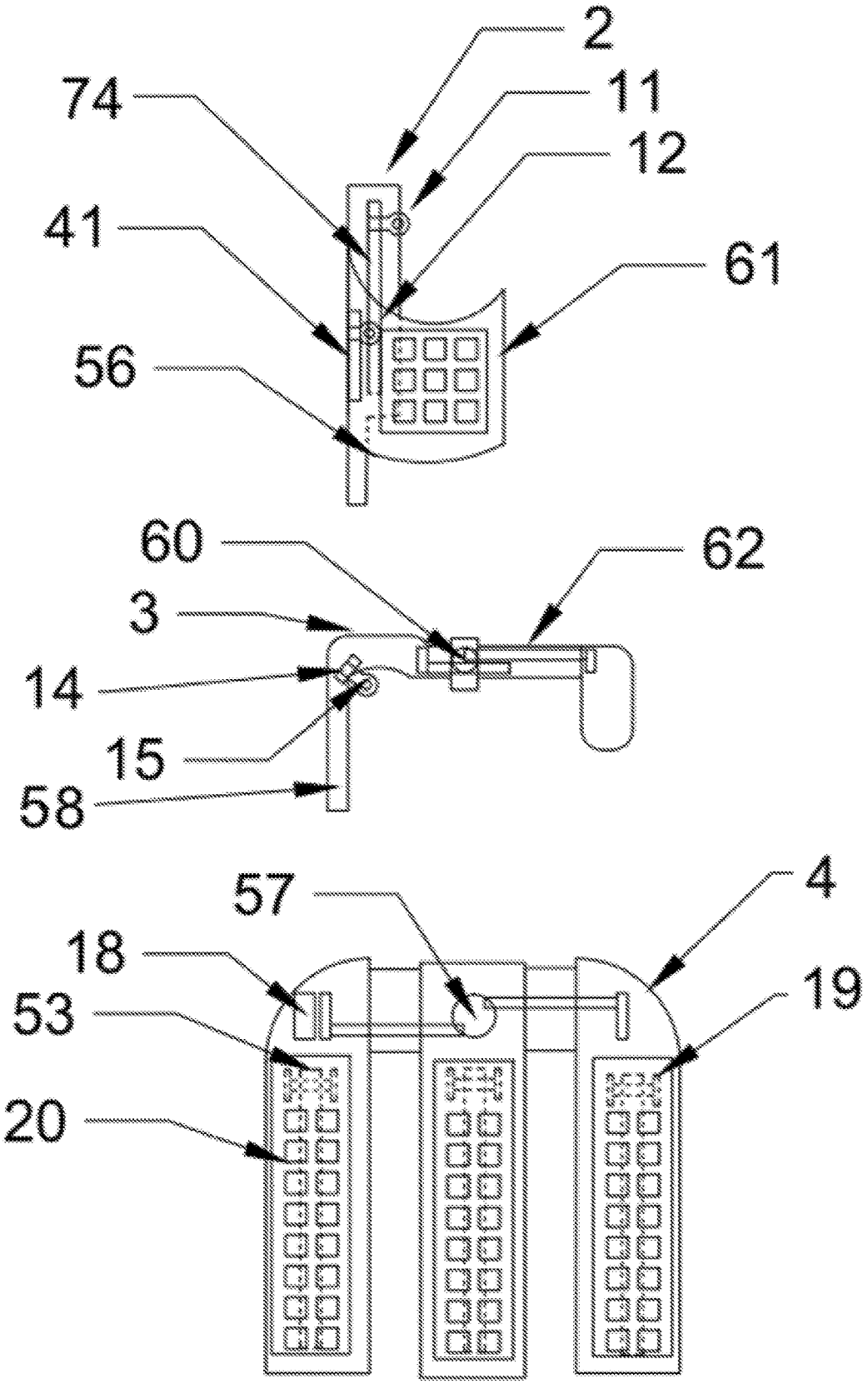
FIG. 11 is an exploded view of FIG. 10.
Figure 12:
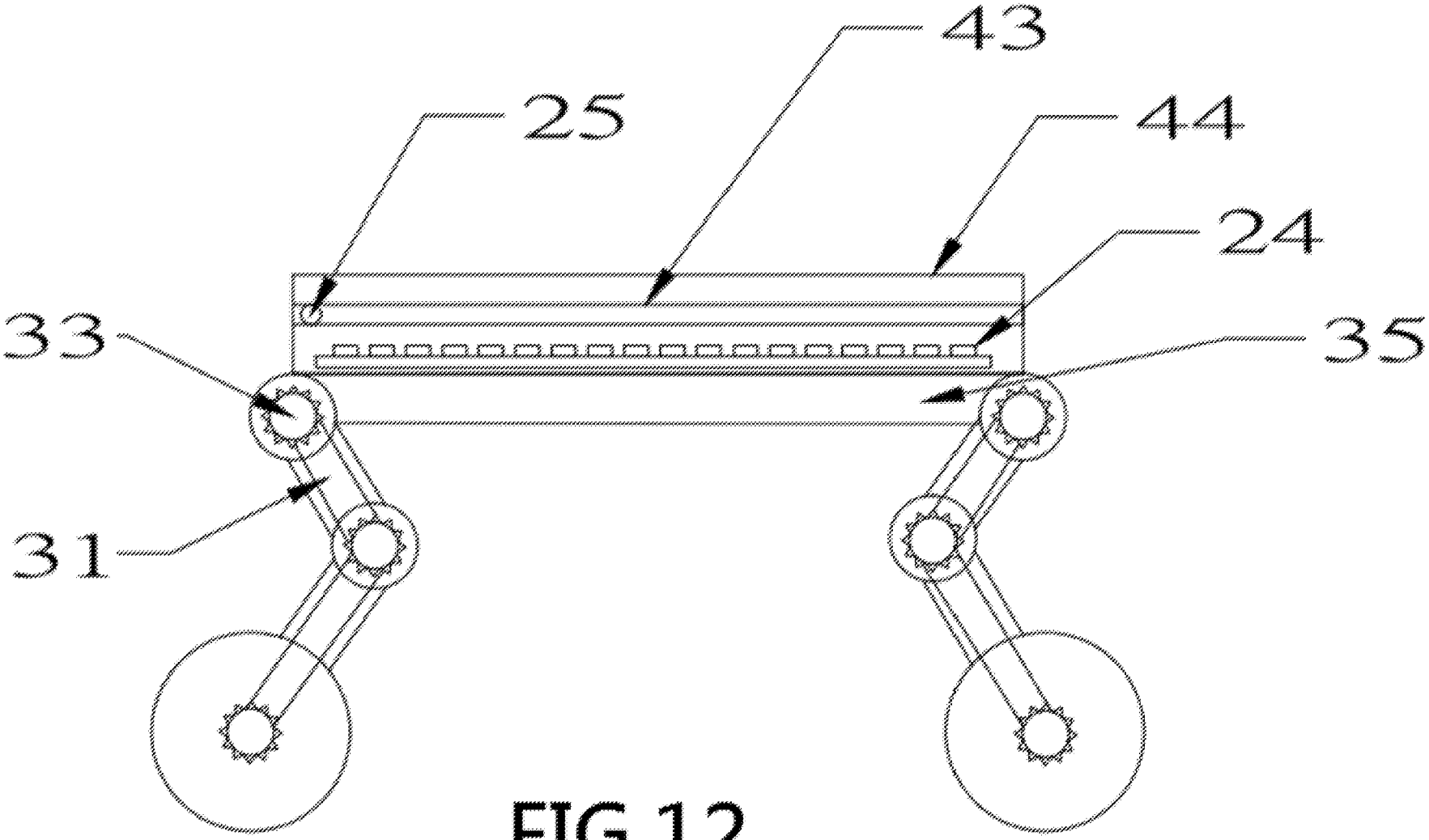
FIG. 12 is a side elevation of the armrest massaging device.
Figure 13:
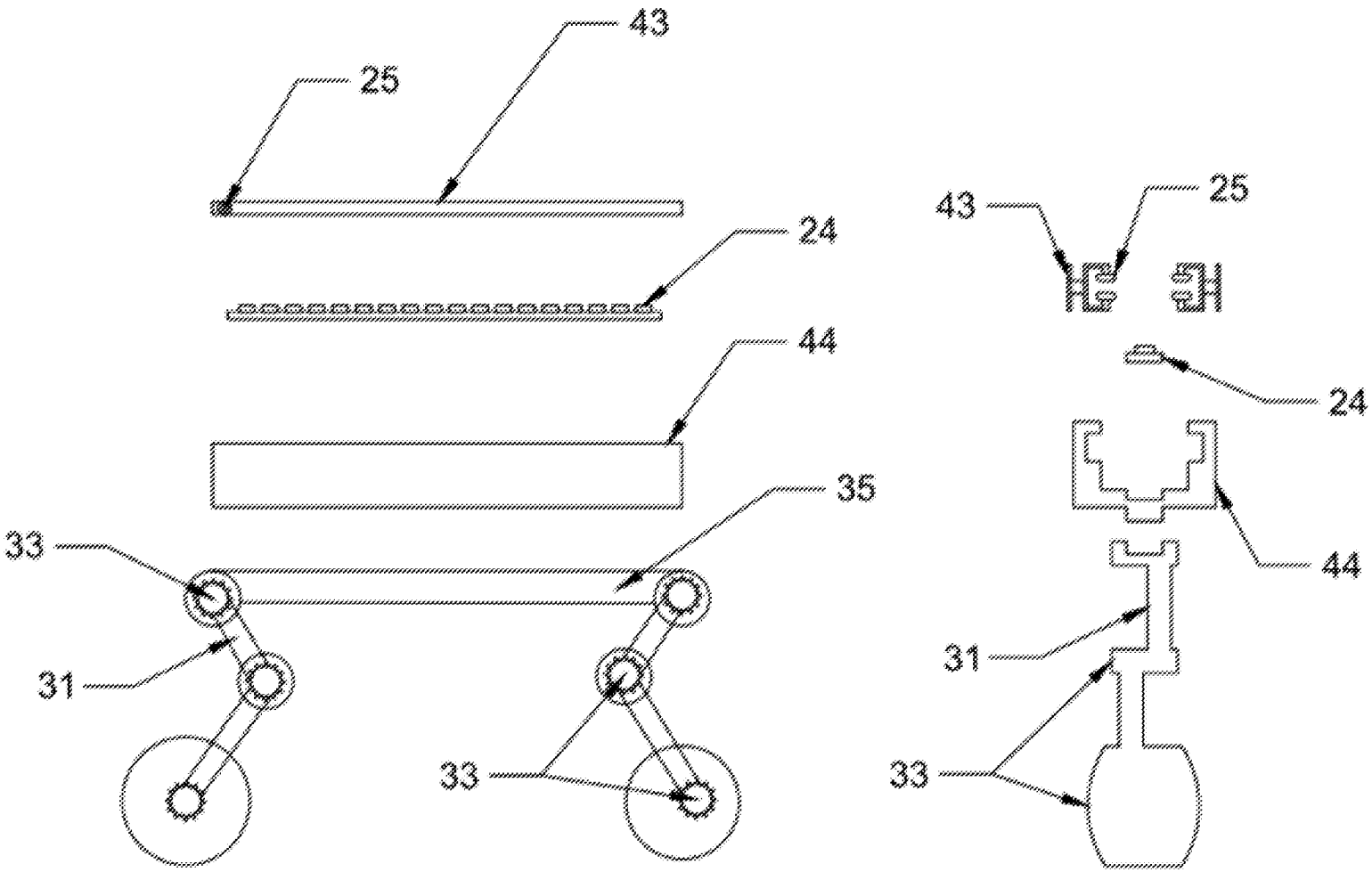
FIG. 13 is an exploded view of FIG. 12.
Figure 14:
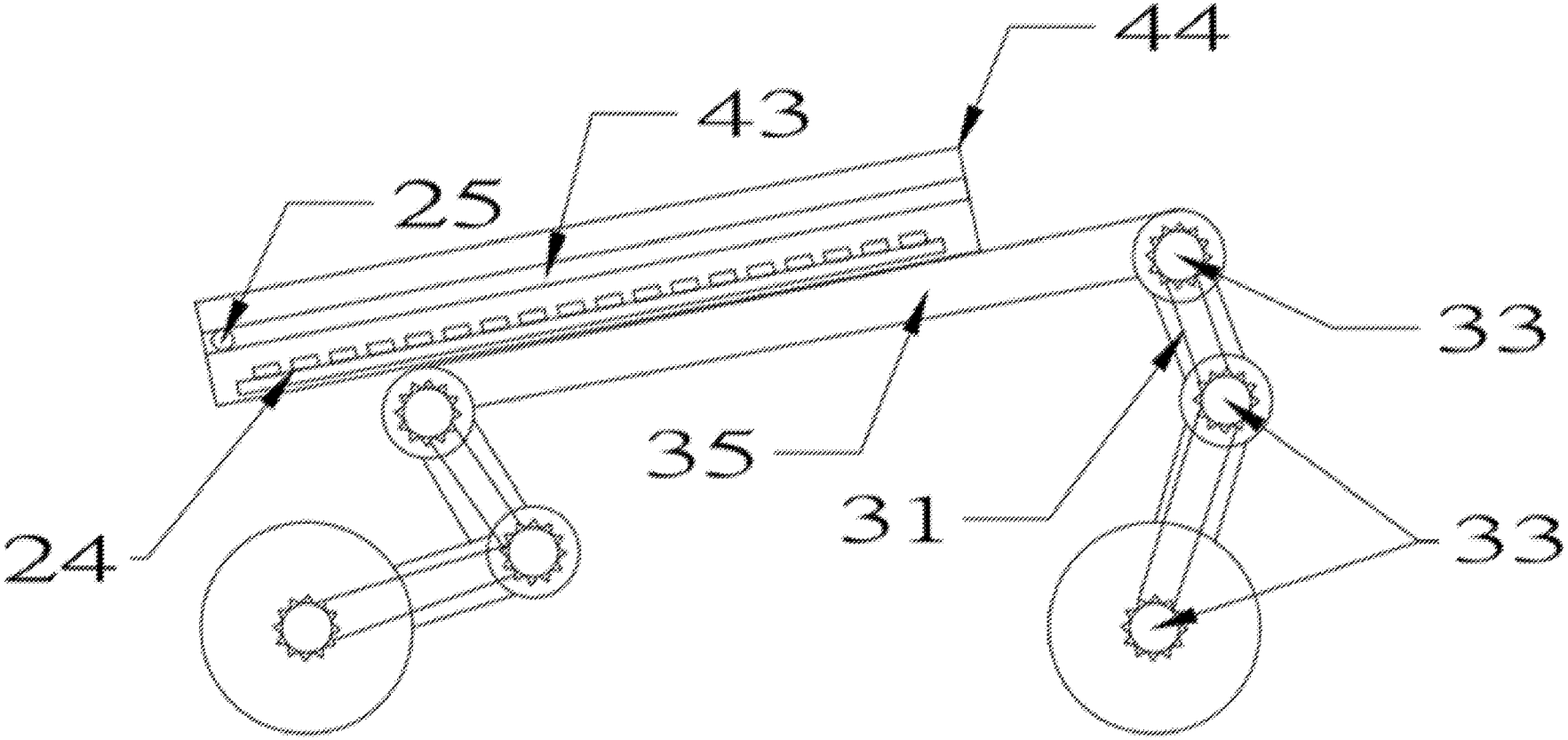
FIG. 14 is a view similar to FIG. 12 showing the armrest massaging device in operation.
Figure 15:
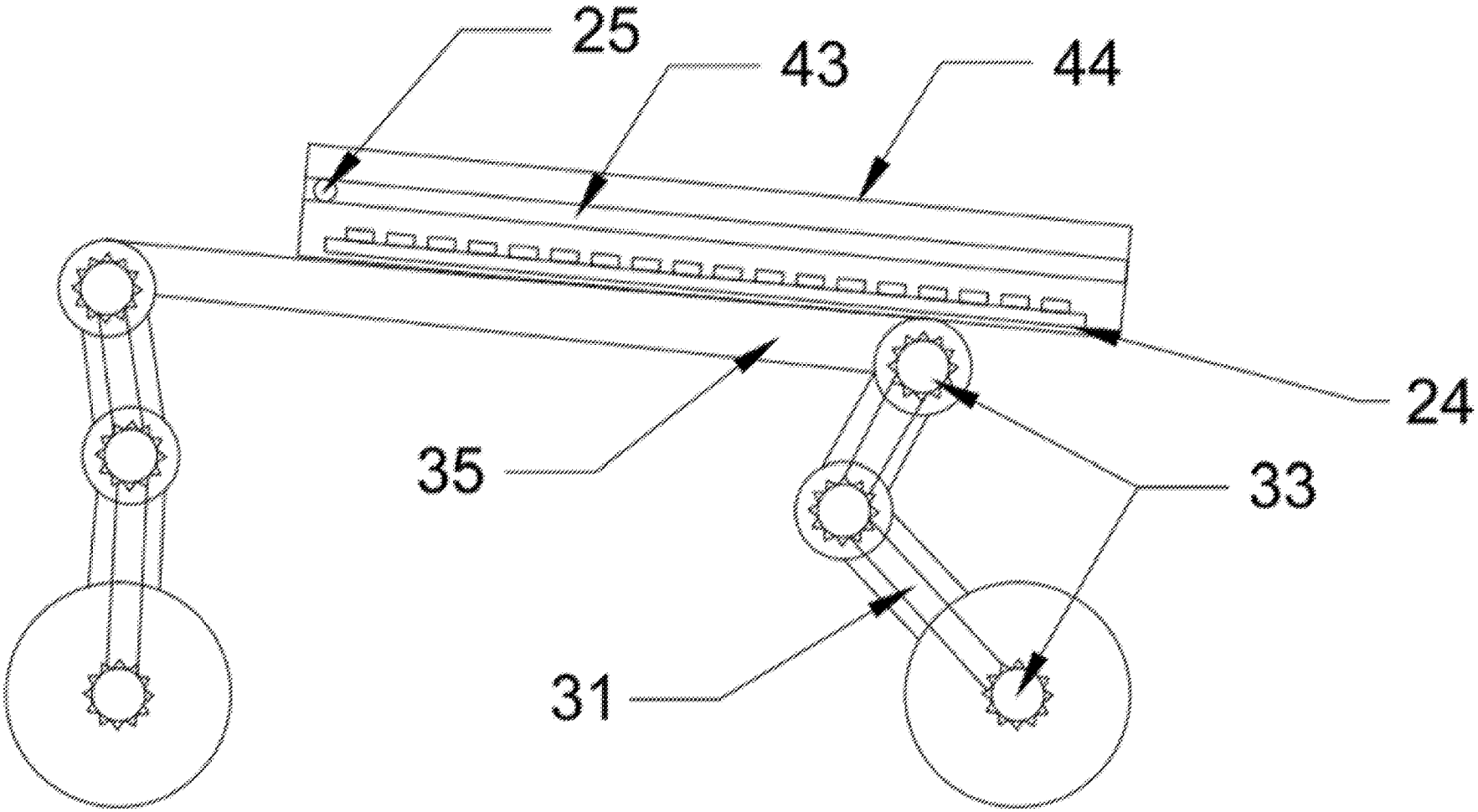
FIG. 15 is a view similar to FIG. 14 showing the armrest massaging device in further operation.
Figure 16:
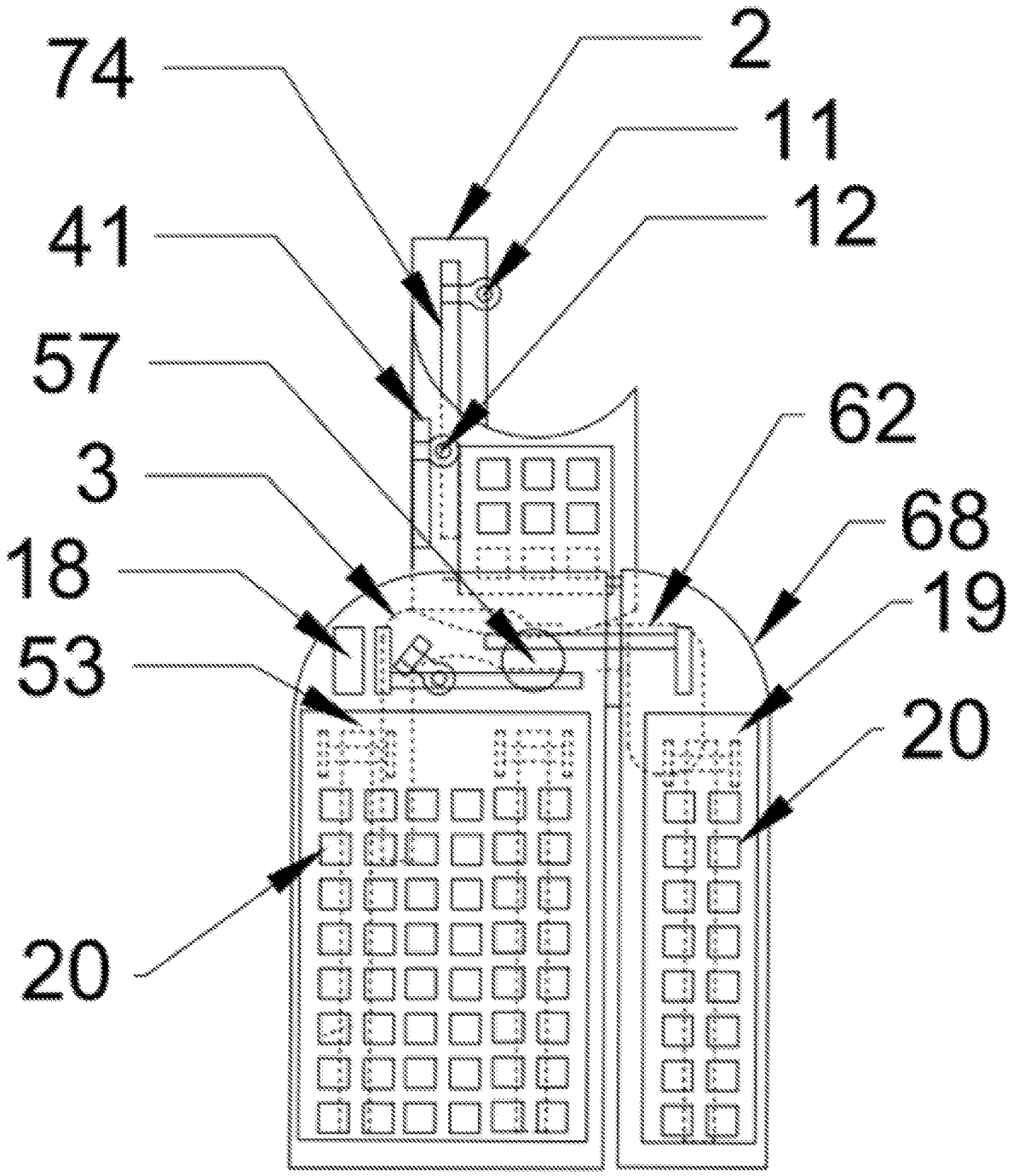
FIG. 16 is a side elevation showing the shoulder massaging device, the neck massaging device, and the arm massaging devices of a second embodiment.
Figure 17:
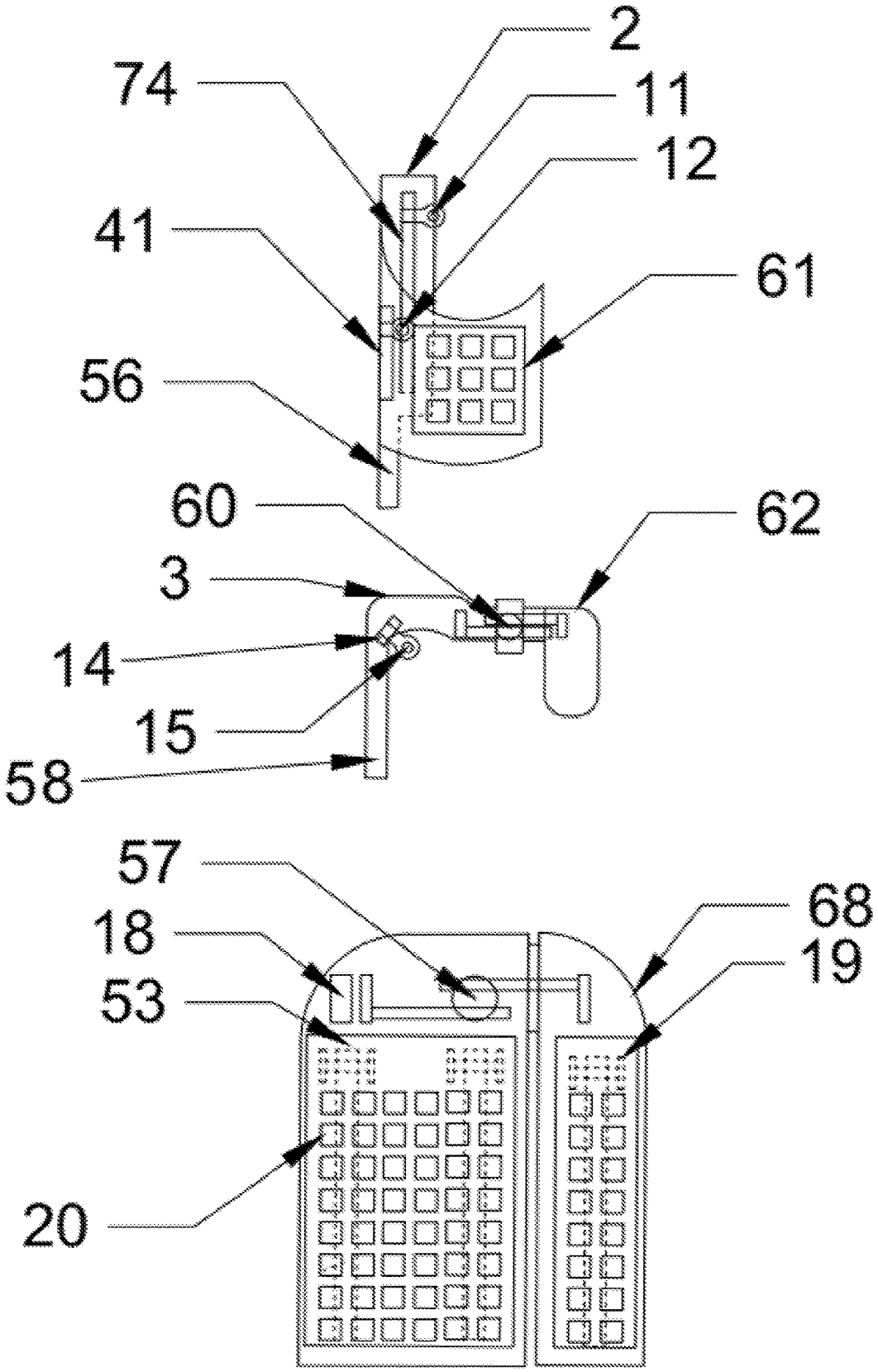
FIG. 17 is an exploded view of FIG. 16.
Figure 18:
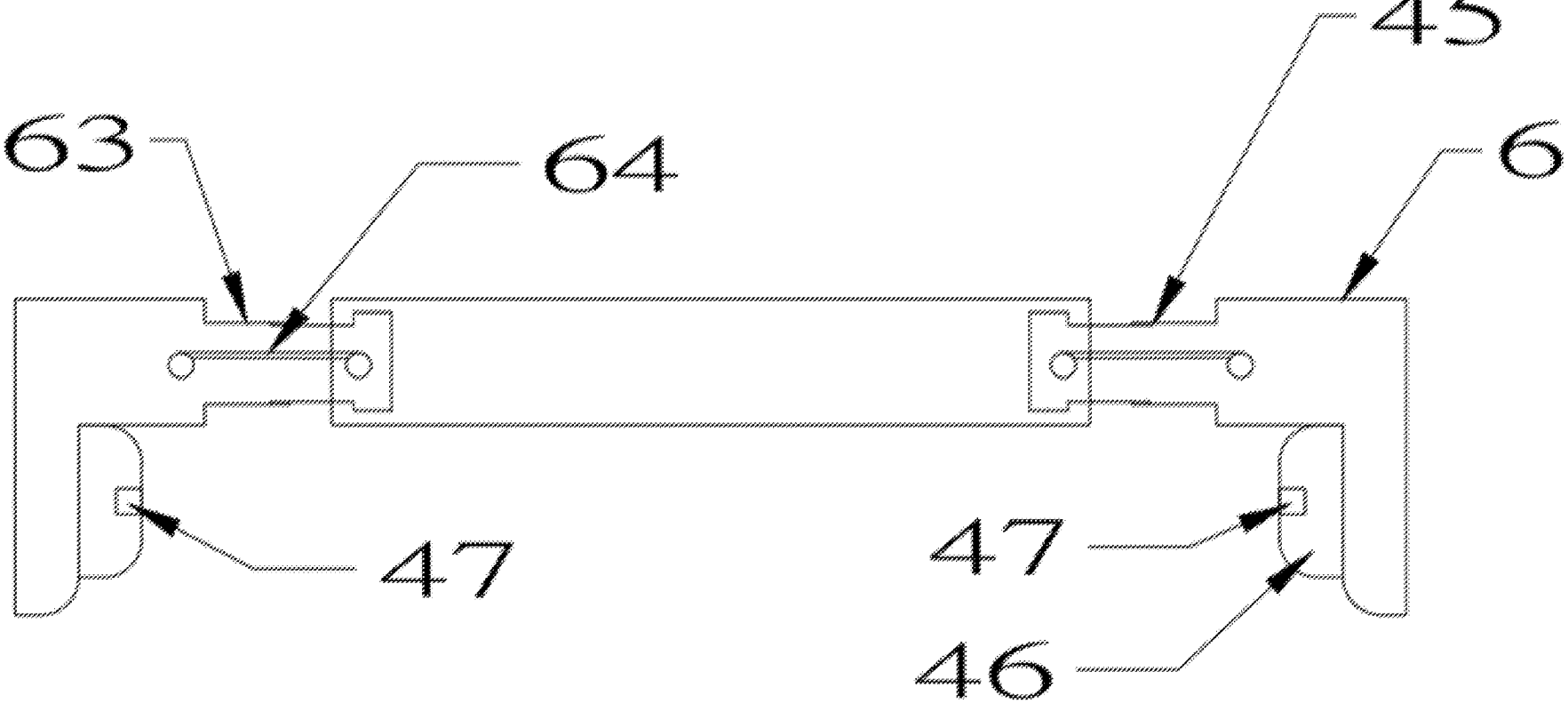
FIG. 18 is a top view of the seat positioning device.
Figure 19:
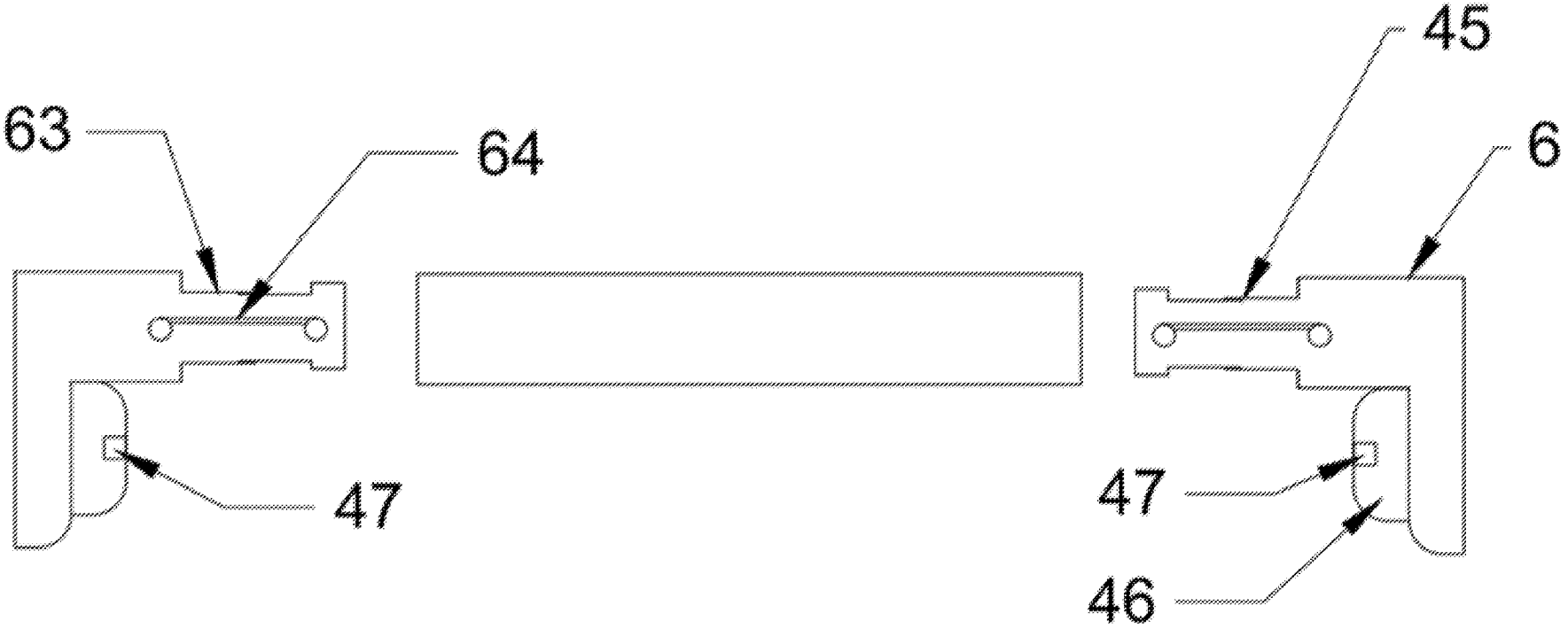
FIG. 19 is an exploded view of FIG. 18.
Figure 20:
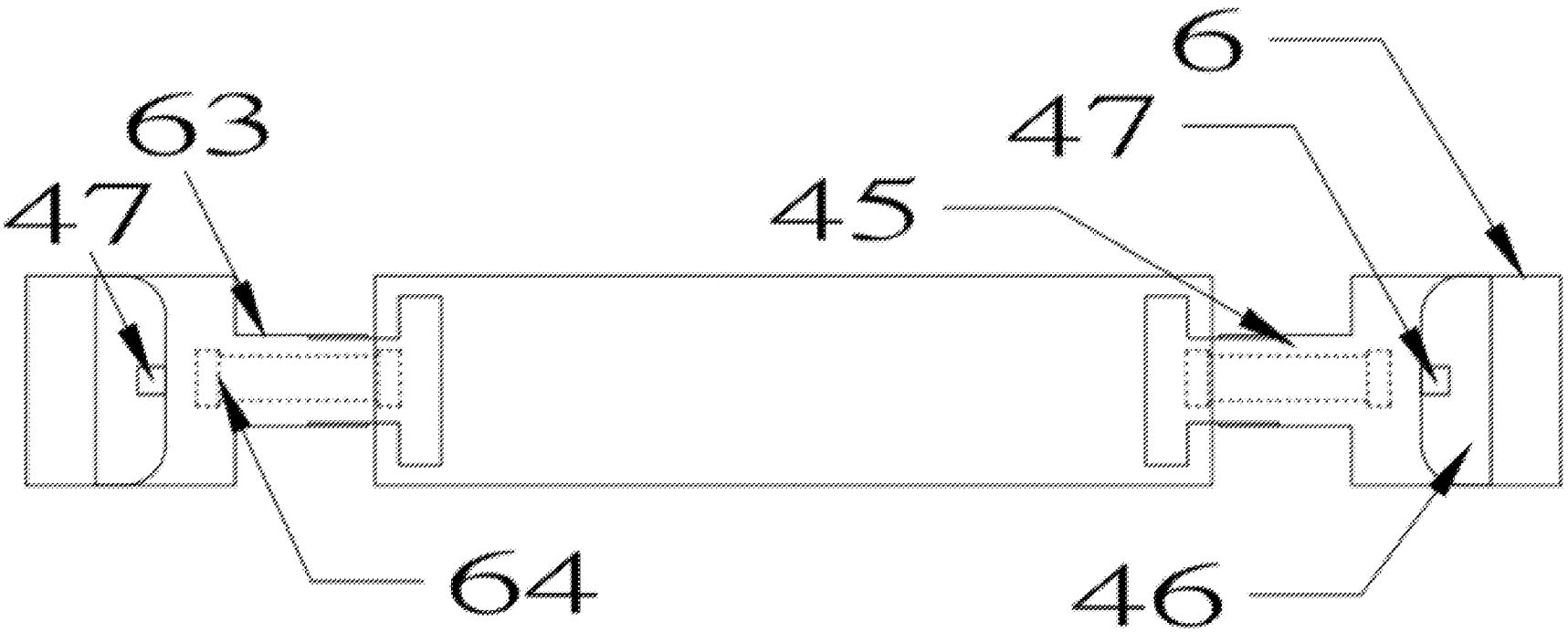
FIG. 20 is a front view of the seat positioning device.
Figure 21:
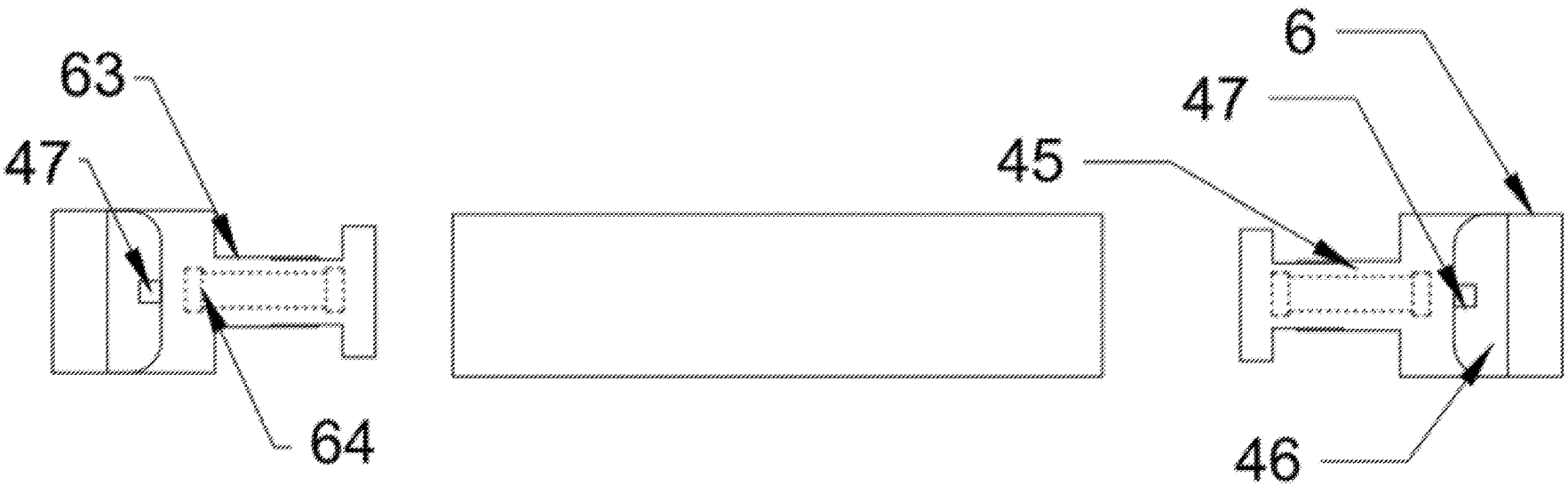
FIG. 21 is an exploded view of FIG. 20.
Figure 22:
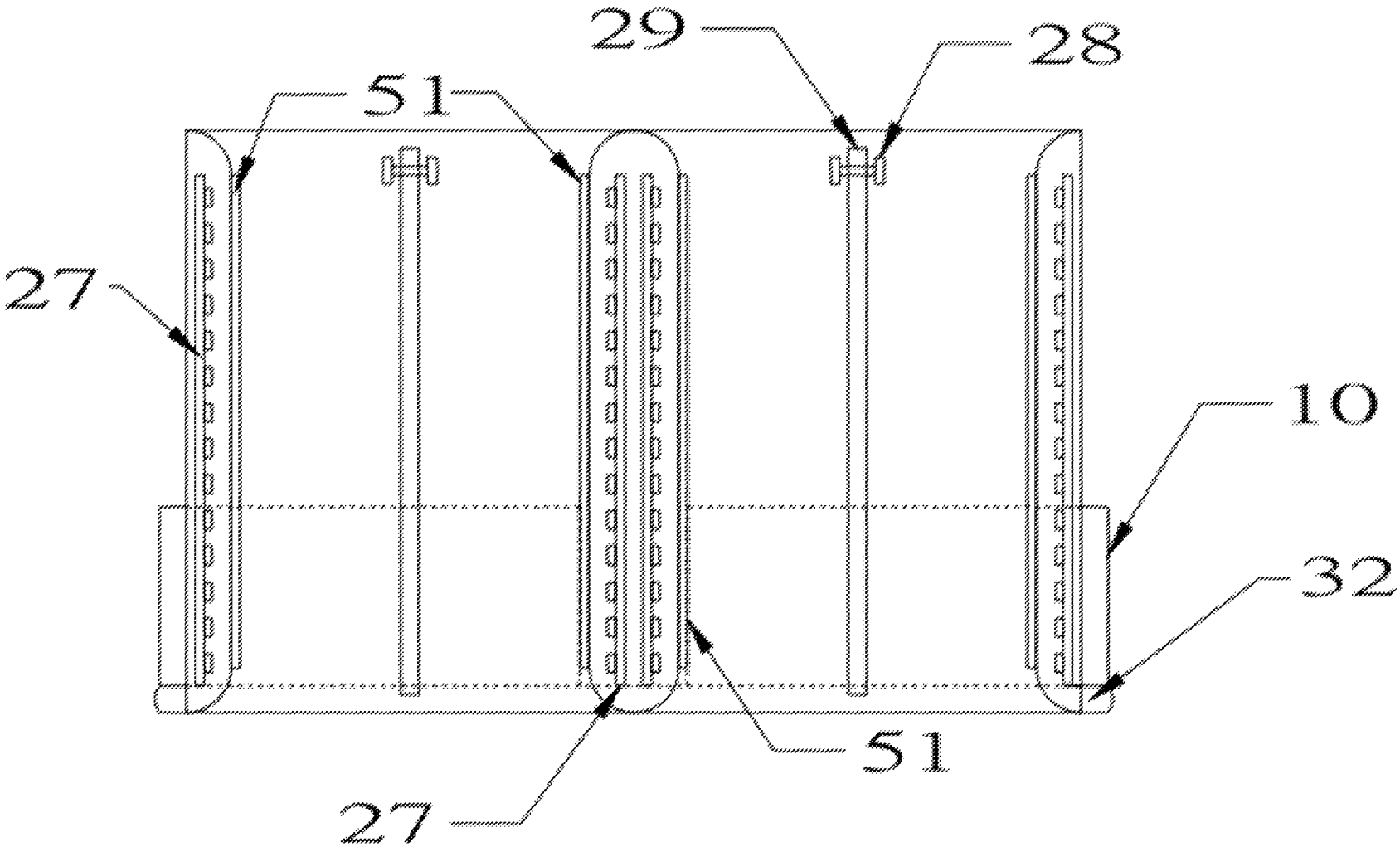
FIG. 22 is a front view of the leg massaging device.
Figure 23:
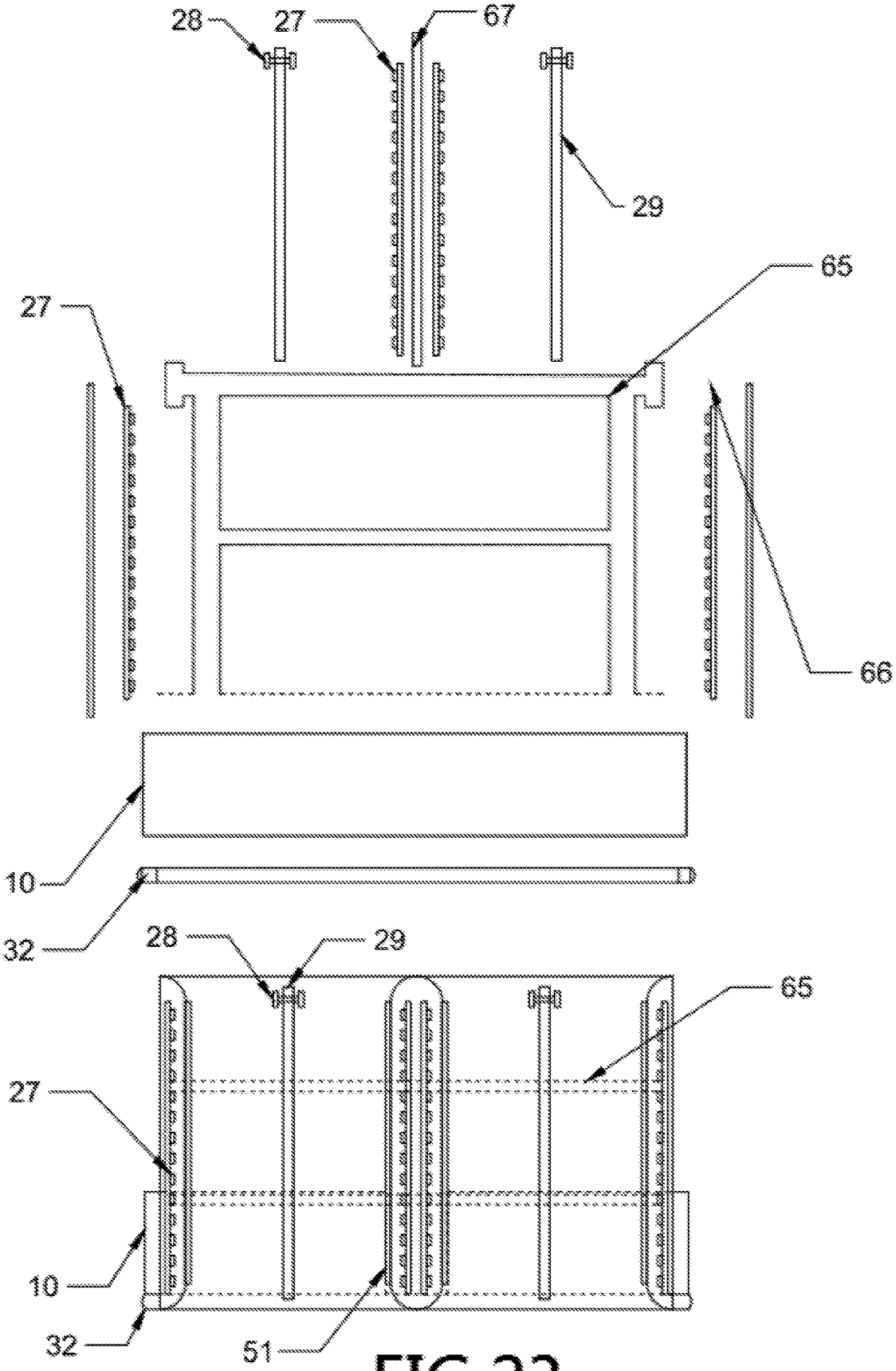
FIG. 23 is an exploded view of FIG. 22.
Figure 24:
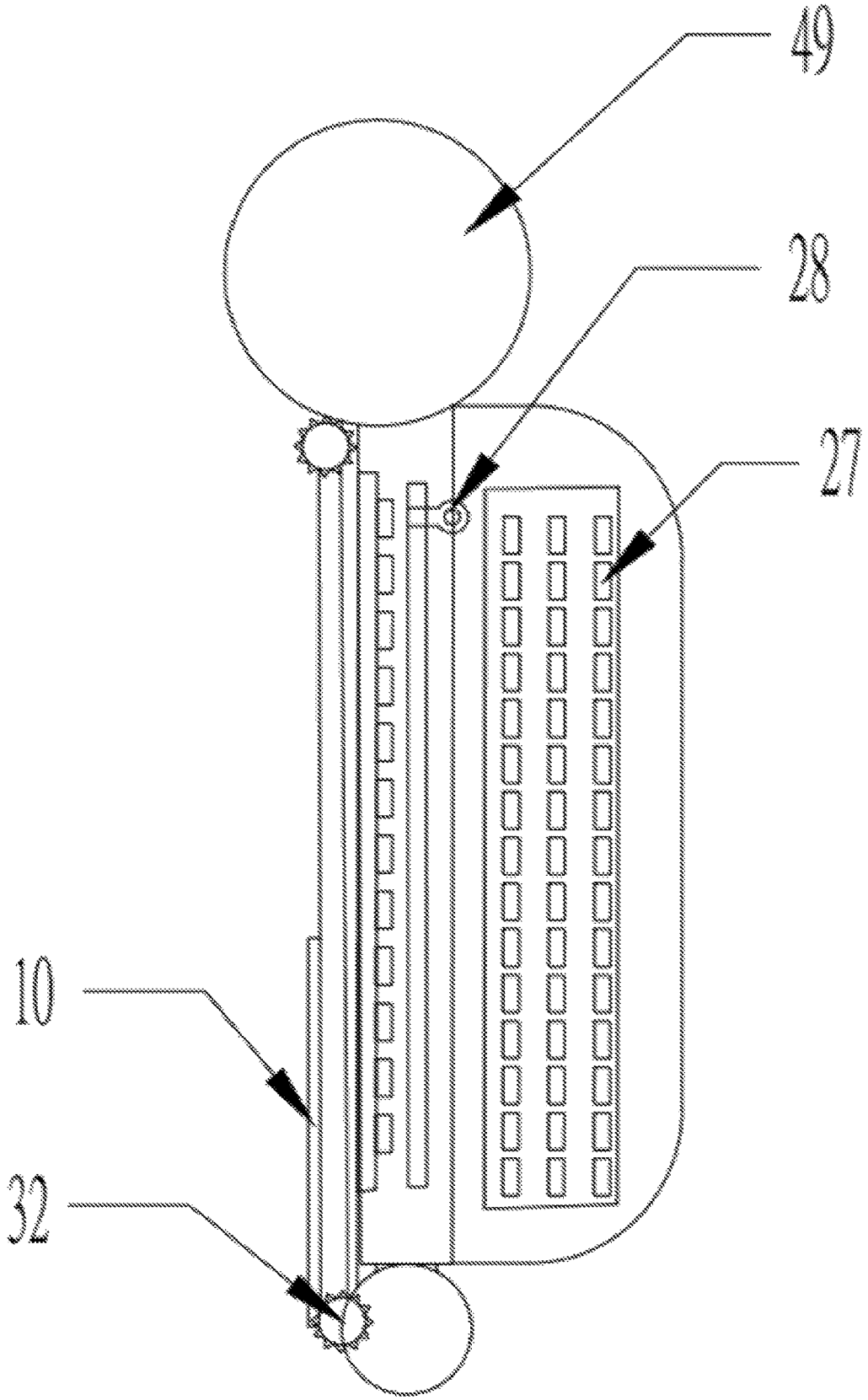
FIG. 24 is a side elevation of FIG. 22.
Figure 25:
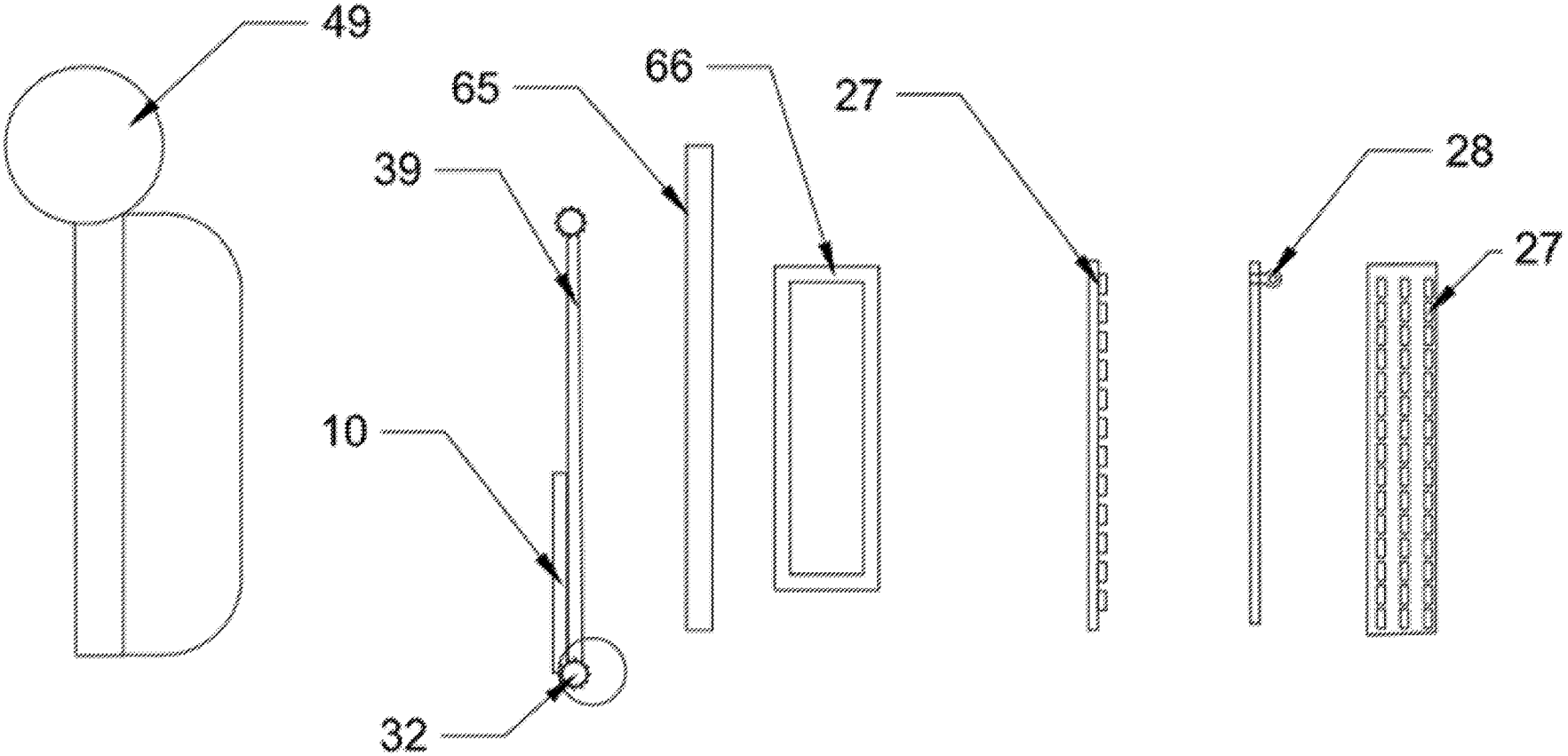
FIG. 25 is an exploded view of FIG. 24.
Figure 26:
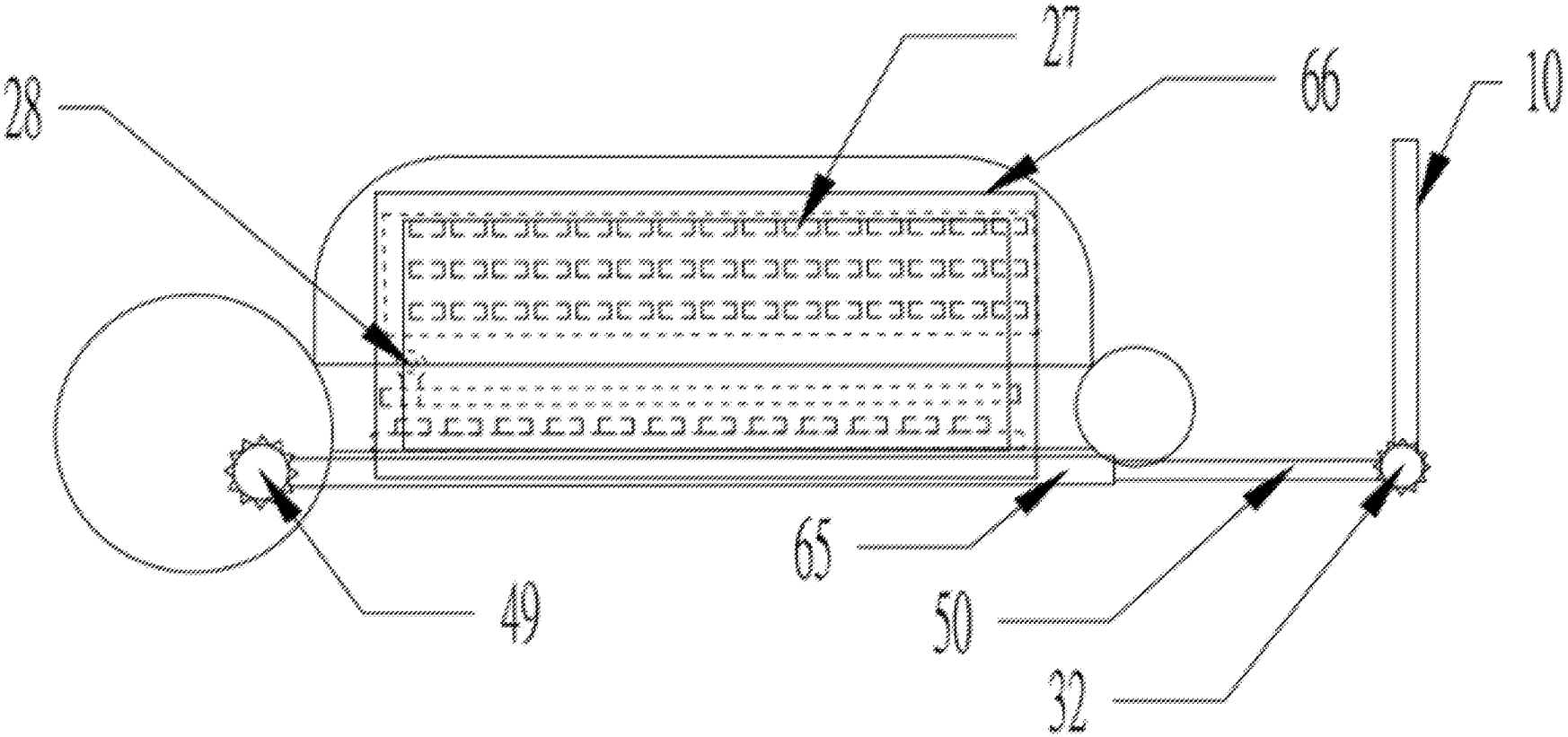
FIG. 26 is a view similar to FIG. 24 showing the leg massaging device in operation.
Figure 27:
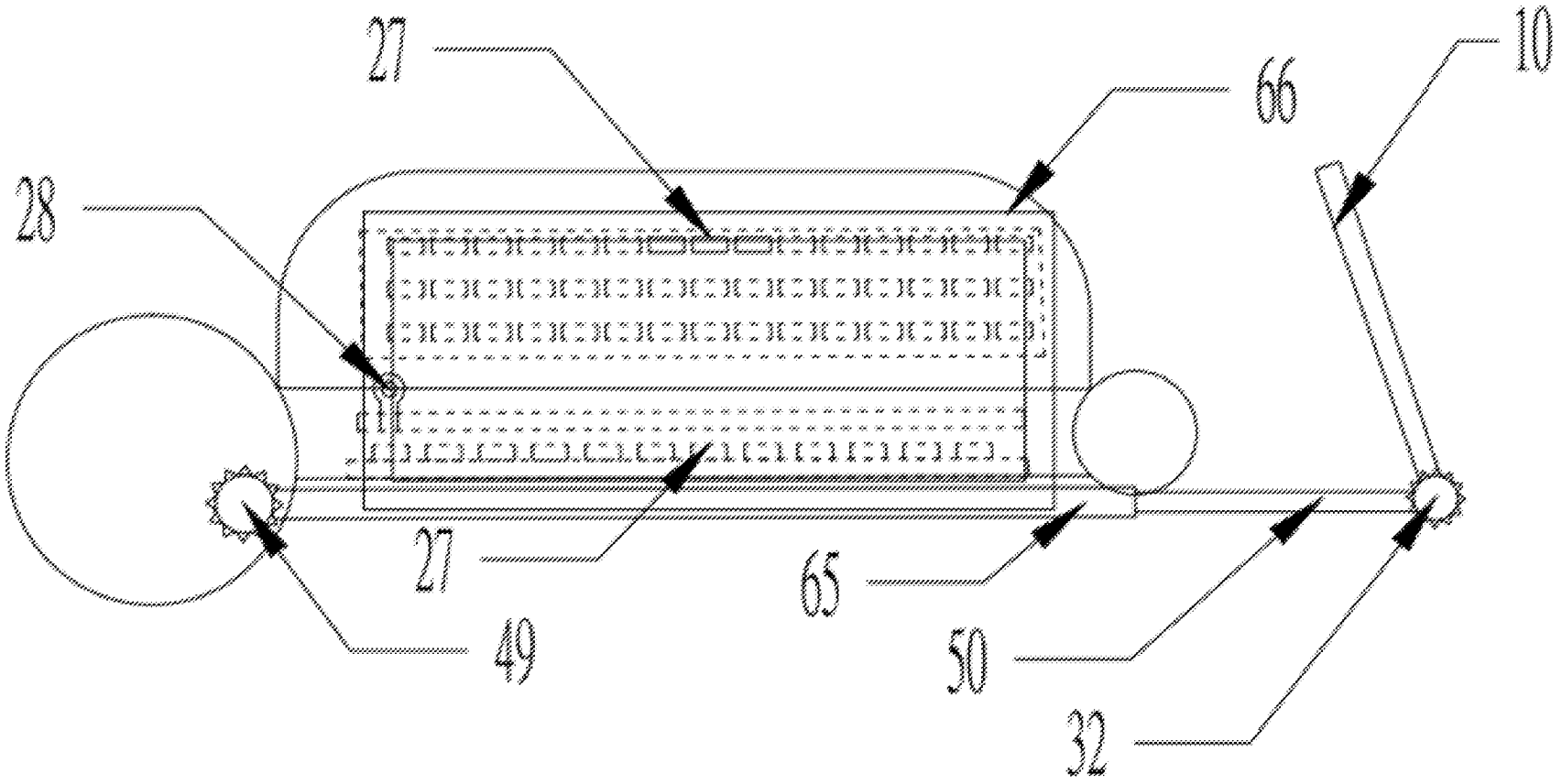
FIG. 27 is a view similar to FIG. 26 showing the leg massaging device in further operation.
Figure 28:
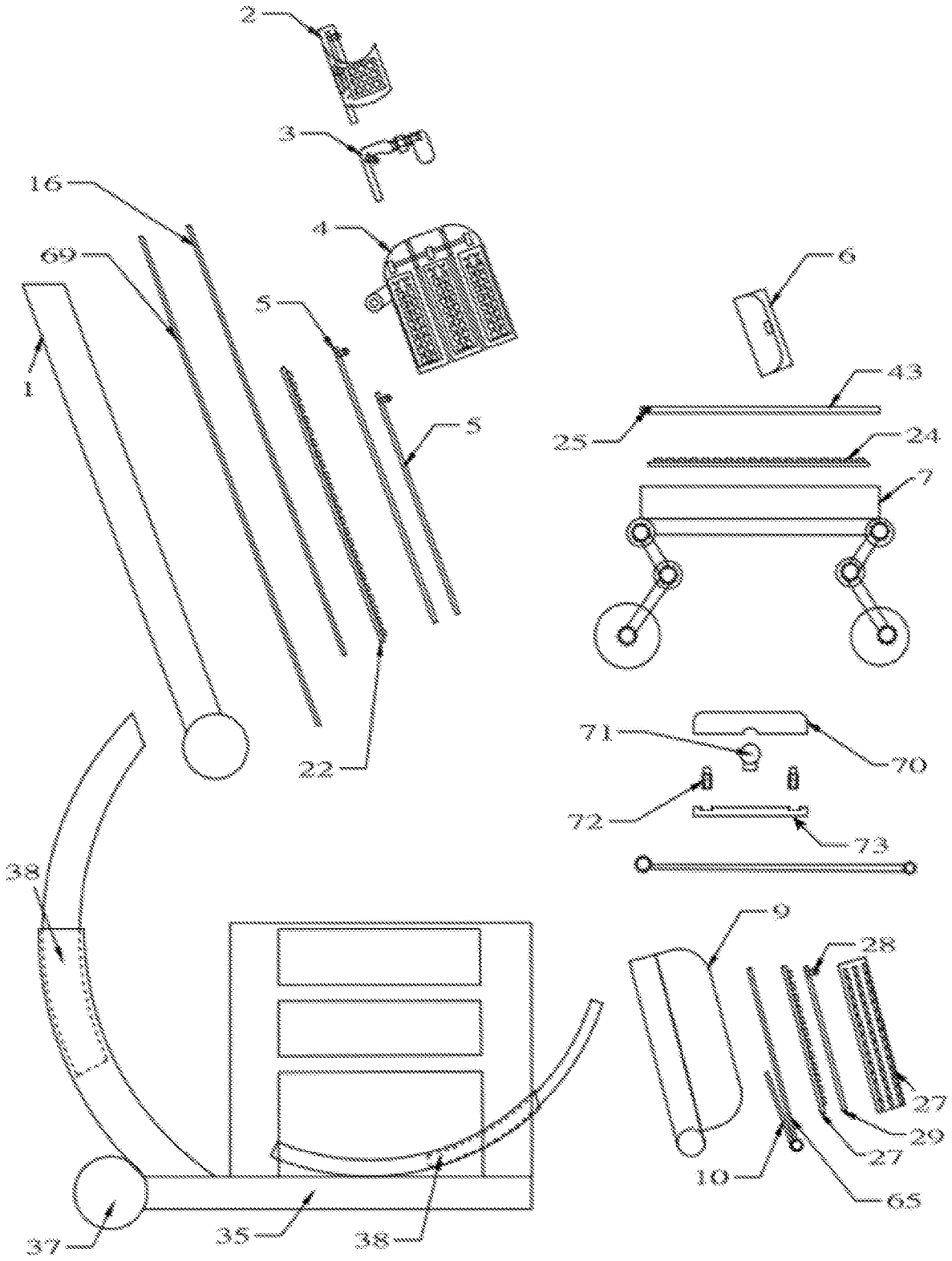
FIG. 28 is an exploded view of FIG. 2.
Figure 29:
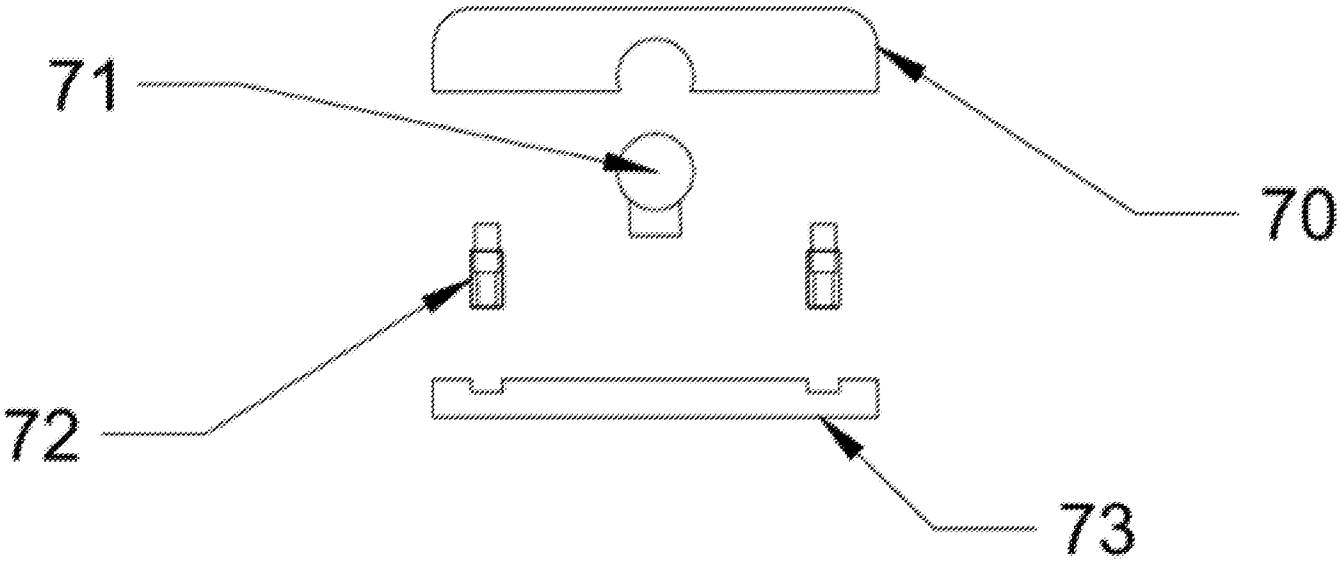
FIG. 29 is an exploded view of the vibrational massaging seat of the buttocks massaging device.

Referring to FIGS. 1 to 29, a multi-direction operable massage chair 1 in accordance with the invention comprises the following components as discussed in detail below. A seat positioning device 6 may move along the x-axis. A seat sensor 47 of a limit member 46 may sense any movement of the seat positioning device 6 and in turn the limit member 46 may deactivate the seat positioning device 6 after the seat positioning device 6 has moved to a desired position. Then a neck massaging device 2, a shoulder massaging device 3, and an arm massaging device 4 together move along a main rail 16 in the y-axis direction until a first set of rollers 15 of the shoulder massaging device 3 sense the body of a user. The neck massaging device 2 moves along its axis 13 until a second set of rollers 12 contact the body. Then the arm massaging device 4 moves along its axis 18 until a third set of rollers 19 contact the arm. A width adjustment axis 57 of the arm massaging device 4 moves toward the arm until the third set of rollers 19 contact the arm. A back massaging device 5 moves along the main rail 16 in Y-axis direction until a height limit sensor 17 senses the shoulder massaging device 3. Thus a highest position of the movement of the shoulder massaging device 3 is determined. A leg positioning device 51 of a leg massaging device 9 is inflated until both leg sensors 52 contact and sense the body of the user. A vibrational massaging seat 26 of a buttocks massaging device includes an adjustment member 71 and two adjustment cylinders 72 and is configured to adjust an angle of the vibrational massaging seat 26 with respect to the user. The vibrational massaging seat 26 activates the buttocks massaging device to do vibrating massaging operation. After all components are in position, the massaging operation begins in which a first set of roller members 11 roll on a first rail 74, and the second set of rollers 12 roll on a rail 41 in the y-axis direction. The first set of rollers 15 roll on a rail 14 in the x-axis direction. The third set of rollers 19 roll on a rail 53 in the y-axis direction. All or a portion of a second set of roller members 21 may roll on the main rail 16 in the y-axis direction. A first infrared temperature sensor 20, a second infrared temperature sensor 61, a third infrared temperature sensor 22, and a fourth infrared temperature sensor 27 are activated to sense temperatures of the arm, the neck, the back, and the leg respectively. Power will be adjusted automatically if the sensed temperature reaches a predetermined value. The back of the massage chair 1 will be reclined after the massage. A board adjustment member 50 of the leg massaging device 9 extends (see FIG. 26). Next, a board 10 of the leg massaging device 9 rotates 270 degrees. Next, the board adjustment member 50 of the leg massaging device 9 retracts until the board 10 of the leg massaging device 9 engages with the foot soles of the user. Finally, a leg stretching operation is performed (see FIG. 27). A third set of roller members 25 roll on a second rail 43 in a horizontal direction. Both an armrest link 31 and an armrest pivot 33 may pivot for adjusting height and angle in response to an adjusted angle of the back with respect to the ground. The massaging operation including rubbing, kneading, punching, vibrating, and strength can be controlled by a panel or a mobile phone. Further, a pivotal angle of the board 10 can be adjusted.

While the invention has been described in terms of preferred embodiments, those skilled in the art will recognize that the invention can be practiced with modifications within the spirit and scope of the appended claims.

What is claimed is:

1. A massage chair, comprising:

a seat positioning device configured to move along the x-axis;

a seat sensor of a limit member configured to sense a movement of the seat positioning device wherein the limit member is configured to deactivate the seat positioning device after the seat positioning device has moved to a predetermined position;

a neck massaging device, a shoulder massaging device, and an arm massaging device together configured to move along a main rail in the y-axis direction until a first set of rollers sense a user wherein the neck massaging device is configured to move along the y-axis direction until a second set of rollers contact the user, and the arm massaging device is configured to move along the y-axis direction until a third set of rollers contact the arm of the user;

a width adjustment axis of the arm massaging device configured to move toward the arm until the third set of rollers contact the arm of the user;

a back massaging device configured to move along the main rail in the y-axis direction until a height limit sensor senses the shoulder massaging device;

a leg positioning device of a leg massaging device is inflated until two leg sensors contact and sense the user;

a vibrational massaging seat including an adjustment member and two adjustment cylinders configured to adjust an angle of the vibrational massaging seat with respect to the user;

a first set of roller members configured to roll on a first rail;

a second set of roller members configured to roll on the main rail in the y-axis direction;

a third set of roller members configured to roll on a second rail in a horizontal direction;

first, second, third, and fourth infrared temperature sensors configured to sense temperatures of the arms, the neck, the back, and the legs of the user respectively;

a board adjustment member of the leg massaging device configured to extend or retract;

a board of the leg massaging device configured to rotate;

an armrest link configured to pivot; and an armrest pivot configured to pivot.

* * * * *